US011316273B2

(12) United States Patent
Maruyama et al.

(10) Patent No.: US 11,316,273 B2
(45) Date of Patent: Apr. 26, 2022

(54) ANTENNA DEVICE

(71) Applicant: Mitsubishi Electric Corporation, Chiyoda-ku (JP)

(72) Inventors: Takashi Maruyama, Tokyo (JP); Shigeo Udagawa, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 42 days.

(21) Appl. No.: 16/955,643

(22) PCT Filed: Aug. 30, 2018

(86) PCT No.: PCT/JP2018/032089
§ 371 (c)(1),
(2) Date: Jun. 18, 2020

(87) PCT Pub. No.: WO2019/138603
PCT Pub. Date: Jul. 18, 2019

(65) Prior Publication Data

US 2020/0388926 A1 Dec. 10, 2020

(30) Foreign Application Priority Data

Jan. 10, 2018 (WO) ..... PCT/JP2018/000321

(51) Int. Cl.
*H01P 5/107* (2006.01)
*H01Q 13/08* (2006.01)
(Continued)

(52) U.S. Cl.
CPC ..... *H01Q 13/08* (2013.01); *H01P 1/02* (2013.01); *H01P 3/081* (2013.01); *H01P 5/08* (2013.01); *H01P 5/107* (2013.01); *H01Q 21/08* (2013.01)

(58) Field of Classification Search
CPC ..... H01P 5/107; H01Q 21/08
See application file for complete search history.

(56) References Cited

U.S. PATENT DOCUMENTS 4,716,386 A * 12/1987 Lait ..... H01P 5/107 333/26
6,642,819 B1 11/2003 Jain et al.
(Continued)

FOREIGN PATENT DOCUMENTS

CN 207967300 U * 10/2018
JP 52-83631 6/1977
(Continued)

OTHER PUBLICATIONS

International Search Report dated Oct. 2, 2018 in PCT/JP2018/032089 filed on Aug. 30, 2018, 2 pages.
(Continued)

*Primary Examiner* — Daniel Munoz
(74) *Attorney, Agent, or Firm* — Oblon, McClelland, Maier & Neustadt, L.L.P.

(57) ABSTRACT

A waveguide microstrip line converter includes a waveguide, a dielectric substrate, a ground conductor including a slot, and a line conductor. The line conductor includes a first section that is a microstrip line having a first line width, a conversion unit that is a second section positioned immediately above the slot and having a second line width greater than the first line width, and a third section extending from the second section in a first direction and performing impedance matching between the first section and the second section. One of the opposite ends of the third section in the first direction is connected to the second section. The first section extends in a second direction perpendicular to the first direction continuously from the other end of the opposite ends of the third section.

19 Claims, 21 Drawing Sheets

(51) Int. Cl.

| | |
|---|---|
| ***H01P 1/02*** | (2006.01) |
| ***H01Q 21/08*** | (2006.01) |
| ***H01P 3/08*** | (2006.01) |
| ***H01P 5/08*** | (2006.01) |

(56) References Cited

U.S. PATENT DOCUMENTS

| | | | |
|---|---|---|---|
| 2008/0036662 | A1 | 2/2008 | Iwata et al. |
| 2009/0256777 | A1 | 10/2009 | Nagai |
| 2011/0267153 | A1 | 11/2011 | Hirota et al. |
| 2012/0256795 | A1 | 10/2012 | Tajima |

FOREIGN PATENT DOCUMENTS

| | | | |
|---|---|---|---|
| JP | 64-60008 | A | 3/1989 |
| JP | 11-195924 | A | 7/1999 |
| JP | 2002-198742 | A | 7/2002 |
| JP | 2010-268228 | A | 11/2010 |
| JP | 5289551 | B2 | 9/2013 |
| WO | WO 2005/099039 | A1 | 10/2005 |
| WO | WO 2006/132032 | A1 | 12/2006 |
| WO | WO 2011/096381 | A1 | 8/2011 |

OTHER PUBLICATIONS

Maruyama et al., "Via-less Waveguide-Microstrip Line Transition Using Multistage Impedance Transformers," The Institute of Electronics, Information and Communication Engineers General Conference 2017, Mar. 2017, p. 43 (with English translation, total 6 pages).

Office Action dated Mar. 9, 2021 in corresponding Japanese Patent Application No. 2019/585111 (with English Translation), 7 pages.

Office Action dated Mar. 9, 2021 in corresponding Japanese Patent Application No. 2019-564283 (with English Translation), 7 pages.

H. Nakajima, et al., "Through-hole Less Microstrip Line To Waveguide Transition With Quarter-Wavelength Open Stubs", Proceedings of ISAP2016, Okinawa, Japan, 3A2-4, pp. 550-551.

* cited by examiner

ANTENNA DEVICE

FIELD

The present invention relates to an antenna device capable of mutually converting power between power propagating through a waveguide and power propagating through a microstrip line.

BACKGROUND

A waveguide microstrip line converter connects a waveguide and a microstrip line to transmit a signal from the waveguide to the microstrip line or from the microstrip line to the waveguide. The waveguide microstrip line converter is widely used for antenna devices that transmit a microwave band or millimeterwave band high-frequency signal.

A waveguide microstrip line converter has been known in which a ground conductor is provided on one of the opposite surfaces of a dielectric substrate, while a microstrip line is provided on the other surface. An opening end of the waveguide is connected to the ground conductor. Patent Literature 1 discloses a waveguide microstrip line converter in which a ground conductor and a conductor plate connected to a microstrip line are electrically connected through a conducting structure embedded in a dielectric substrate. The conducting structure is formed from a plurality of through holes located in such a manner as to surround an open end of a waveguide.

CITATION LIST

Patent Literature

Patent Literature 1: Japanese Patent Publication No. 5289551

SUMMARY

Technical Problem

A waveguide microstrip line converter is required to obtain high electric performance in a stable manner and increase the reliability.

The present invention has been made in view of the above, and an object of the present invention is to provide an antenna device that can obtain high electric performance in a stable manner while making it possible to improve the reliability.

Solution to Problem

In order to solve the above problems and achieve the object, a waveguide microstrip line converter according to an aspect of the present invention includes: a waveguide including an opening end; a dielectric substrate including a first surface facing the opening end and a second surface opposite to the first surface; a ground conductor provided on the first surface, the opening end being connected to the ground conductor and the ground conductor being provided with a slot in a region surrounded by an edge portion of the opening end; and a line conductor provided on the second surface. The line conductor includes a first section that is a microstrip line having a first line width, a second section positioned immediately above the slot and having a second line width greater than the first line width, and a third section extending from the second section in a first direction and performing impedance matching between the first section and the second section. One end of opposite ends of the third section in the first direction is connected to the second section. The first section extends in a second direction perpendicular to the first direction continuously from another end of the opposite ends of the third section.

Advantageous Effects of Invention

The antenna device according to the present invention has an effect where it is possible to obtain high electric performance in a stable manner while making it possible to improve the reliability.

BRIEF DESCRIPTION OF DRAWINGS

FIG. 2 is a cross-sectional diagram illustrating an internal configuration of the waveguide microstrip line converter according to the first converter illustrated in.

DESCRIPTION OF EMBODIMENT

An antenna according to embodiments of the present invention will be described in detail below with reference to xe accompanying drawings. The present invention is not limited to the embodiments.

First Embodiment

Figure 1:
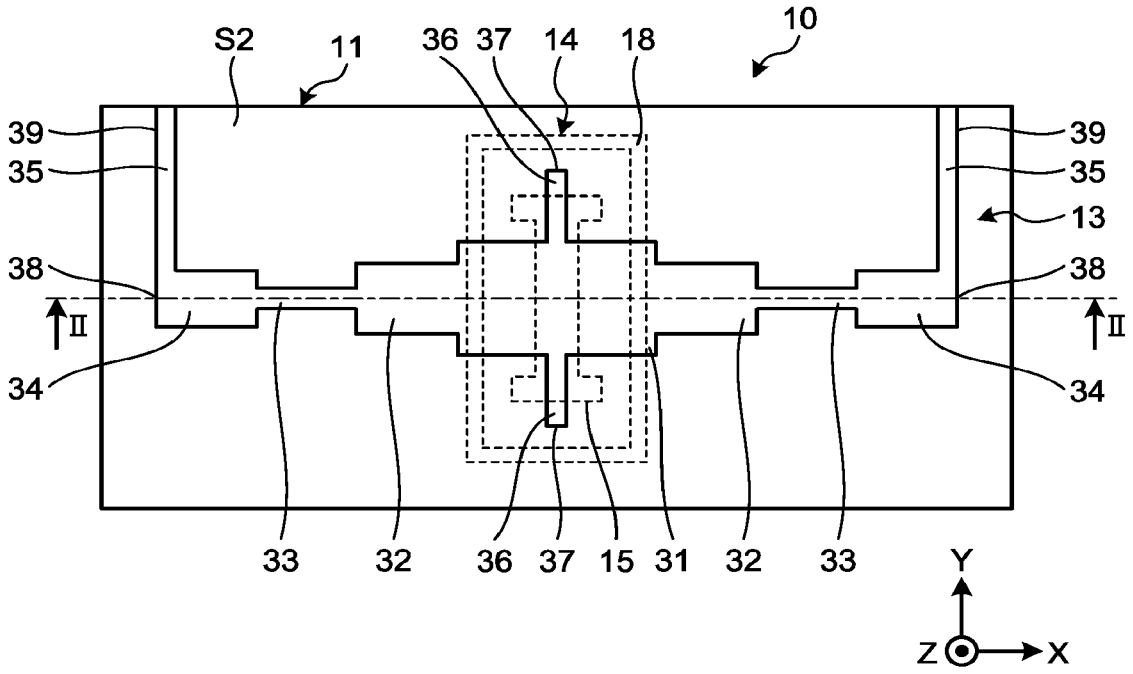
FIG. 1 is a top view illustrating an external configuration of a waveguide microstrip line converter according to a first embodiment of the present invention.
Figure 2:
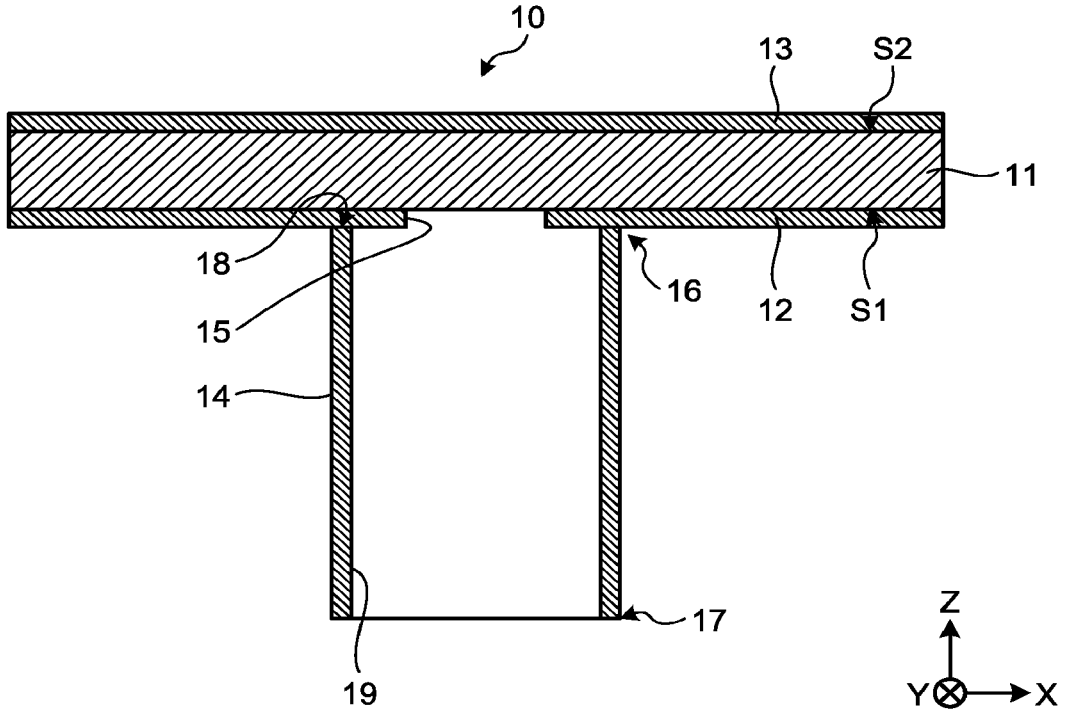

FIG. 1 is a top view illustrating an external configuration of a waveguide microstrip line converter 10 according to a first embodiment of the present invention. FIG. 2 is a cross-sectional diagram illustrating an internal configuration of the waveguide microstrip line converter 10 according to the first embodiment. In FIG. 1, the configuration located beneath the configuration illustrated by a solid line is illustrated by a dotted line in the plane of the drawing.

There are three axes, i.e., an X-axis, a Y-axis, and a Z-axis, that are perpendicular to each other. The direction parallel to the X-axis is defined as an X-axis direction that is a first direction. The direction parallel to the Y-axis is defined as a Y-axis direction that is a second direction. The direction parallel to the Z-axis is defined as a Z-axis direction that is a third direction. The direction illustrated by an arrow in the drawings in the X-axis direction is defined as a positive X direction, while an opposite direction to the positive X direction is defined as a negative X direction. The direction illustrated by an arrow in the drawings in the Y-axis direction is defined as a positive Y direction, while an opposite direction to the positive Y direction is defined as a negative Y direction. The direction illustrated by an arrow in the drawings in the Z-axis direction is defined as a positive Z direction, while an opposite direction to the positive Z direction is defined as a negative Z direction.

The waveguide microstrip line converter 10 includes a waveguide 14 including an opening end 16, and a dielectric substrate 11 including a first surface S1 facing the opening end 16 and a second surface S2 opposite to the first surface S1. The waveguide microstrip line converter 10 includes a ground conductor 12 that is provided on the first surface S1 and to which the opening end 16 is connected, and a line conductor 13 provided on the second surface S2. FIG. 2 illustrates a part of the cross-sectional configuration of the waveguide microstrip line converter 10 around the waveguide 14 taken along line II-II illustrated in FIG. 1.

The waveguide microstrip line converter 10 is capable of mutually converting power between power propagating through the waveguide 14 and power propagating through the line conductor 13. The waveguide 14 and the line conductor 13 are transmission paths through which a high-frequency signal is transmitted. The ground conductor 12 includes a slot 15 formed in a region surrounded by an opening edge portion 18 that is an edge portion of the opening end 16. Both the first surface S1 and the second surface S2 are defined as a surface parallel to the X-axis and the Y-axis. The pipe axial direction of the waveguide 14 is defined as the Z-axis direction. The pipe axis is the center line of the waveguide 14.

Figure 3:
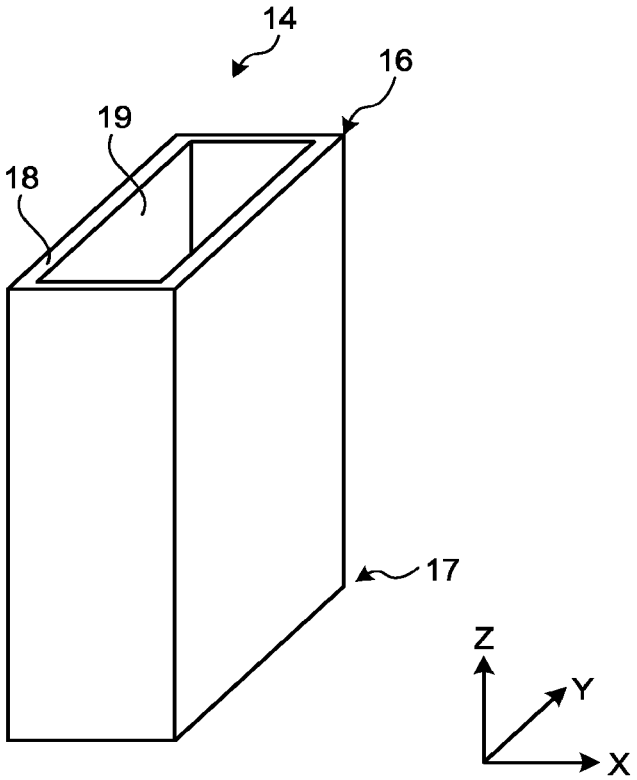
FIG. 3 is a perspective view illustrating an external configuration of a waveguide included in the waveguide microstrip line converter illustrated in FIG. 1.

FIG. 3 is a perspective view illustrating an external configuration of the waveguide 14 included in the waveguide microstrip line converter 10 illustrated in FIG. 1. The waveguide 14 is a rectangular waveguide having a rectangular X-Y cross-section, and is formed of a hollow metal pipe. The waveguide 14 has a rectangular X-Y cross-section with longer sides parallel to the Y-axis and shorter sides parallel to the X-axis. Electromagnetic waves propagate through the internal space of the waveguide 14 surrounded by a pipe wall 19 formed from a metal material. The opening end 16 is one axial end of the pipe of the waveguide 14, and includes the opening edge portion 18 having the same shape as the X-Y cross-section of the waveguide 14. The opening edge portion 18 serves as a short-circuit plane connected to the ground conductor 12. At an input-output end 17 that is the other axial end of the pipe of the waveguide 14, a high-frequency signal to be propagated through the waveguide 14 is input or a high-frequency signal having propagated through the waveguide 14 is output.

Connection of the opening edge portion 18 and the ground conductor 12 is not limited to the connection made by bringing the ground conductor 12 and the opening edge portion 18 into direct contact with each other. It is sufficient if the opening edge portion 18 and the ground conductor 12 are connected such that it is possible to convert a high-frequency signal, and they may be in a non-contact state with each other. It is also permissible that the opening edge portion 18 and the ground conductor 12 are connected to each other by a choke structure or the like provided between the opening edge portion 18 and the ground conductor 12.

In the first embodiment, the waveguide 14 is assumed to have any configuration. It is permissible that the waveguide 14 includes a dielectric substrate formed with a plurality of through holes, instead of the pipe wall 19 formed from a metal material. It is also permissible that the interior of the waveguide 14 surrounded by the pipe wall 19 is filled with a dielectric material. It is permissible that the waveguide 14 has a curvature at corners of the X-Y cross-sectional shape or has an oval cross-sectional shape. Alternatively, the waveguide 14 may be a ridge waveguide.

The dielectric substrate 11 is a flat plate member made of a resin material. The ground conductor 12 is provided on the entirety of the first surface S1 of the dielectric substrate 11. The slot 15 is formed by removing a conductor that is a material of the ground conductor 12 within the X-Y region of the ground conductor 12 surrounded by the opening edge portion 18 of the opening end 16. In one example, the ground conductor 12 is formed by press-bonding a copper foil that is a conductive metal foil onto the first surface S1.

The slot 15 is formed by patterning the copper foil press-bonded onto the first surface S1.

The line conductor 13 is provided on the second surface S2 of the dielectric substrate 11 in such a manner that the line conductor 13 passes immediately above the opening of the waveguide 14. The line conductor 13 is formed by patterning a copper foil press-bonded onto the second surface S2. It is permissible that the ground conductor 12 and the line conductor 13 are metal plates that have been formed in advance and then attached to the dielectric substrate 11.

Figure 4:
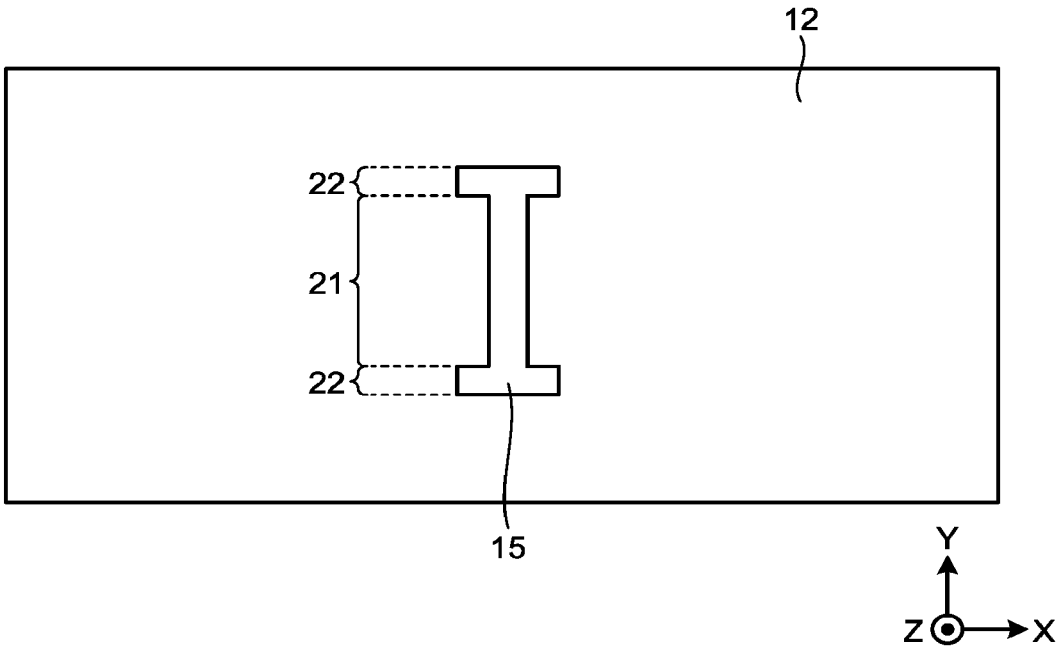
FIG. 4 is a plan view of a ground conductor included in the waveguide microstrip line converter illustrated in FIG. 1.

FIG. 4 is a plan view of the ground conductor 12 included in the waveguide microstrip line converter 10 illustrated in FIG. 1. The slot 15 is an opening portion formed by removing a part of the ground conductor 12. The slot 15 has a planar shape with a greater length in the Y-axis direction than the length in the X-axis direction.

The slot 15 includes end portions 22 positioned at opposite ends of the slot 15 in the Y-axis direction, and a central portion 21 between the end portions 22. The end portions 22 have a width in the X-axis direction greater than the width of the central portion 21 in the X-axis direction. The shape of the slot 15 illustrated in FIG. 4 is referred to as "H-shape" as appropriate. The central portion 21 is positioned immediately below the line conductor 13.

The width of the end portions 22 in the X-axis direction is made greater than the width of the central portion 21 in the X-axis direction, so that the electric field is weakened at the end portions 22, while being strengthened at the central portion 21. As the electric field is strengthened at the central portion 21 of the slot 15 positioned immediately below the line conductor 13, electromagnetic coupling between the line conductor 13 and the opening end 16 of the waveguide 14 is strengthened. Due to this configuration, the waveguide microstrip line converter 10 can more efficiently convert power between the waveguide 14 and the line conductor 13.

As illustrated in FIG. 1, the line conductor 13 includes a first section that is a microstrip line 35, a second section that is a conversion unit 31 positioned immediately above the slot 15, and a third section between the first section and the second section. The third section includes a first impedance transformation unit 32, a second impedance transformation unit 34, and a third impedance transformation unit 33 that are a plurality of impedance transformation units that perform impedance matching between the microstrip line 35 and the conversion unit 31. The line conductor 13 includes two stubs 36 that are branch sections branching off from the conversion unit 31.

The conversion unit 31 is positioned at the center of the line conductor 13 in the X-axis direction. The conversion unit 31 is a section of the line conductor 13 to perform power conversion between the waveguide 14 and the line conductor 13. The first impedance transformation unit 32 is positioned next to the conversion unit 31 in the X-axis direction. The third impedance transformation unit 33 is positioned next to the first impedance transformation unit 32 in the X-axis direction on the opposite side to the conversion unit 31 with respect to the first impedance transformation unit 32. The second impedance transformation unit 34 is positioned between the third impedance transformation unit 33 and the microstrip line 35. In the first embodiment, the microstrip line 35 serves as a line through which a high-frequency signal is input from the outside of the waveguide microstrip line converter 10 to the line conductor 13 and through which a high-frequency signal is output from the line conductor 13 to the outside of the waveguide microstrip line converter 10.

The two stubs 36 are provided at the center position of the conversion unit 31 in the X-axis direction. One of the stubs 36 extends in the positive Y direction from an end of the conversion unit 31 positioned on the positive Y direction side. The other stub 36 extends in the negative Y direction from an end of the conversion unit 31 positioned on the negative Y direction side. Each of the stubs 36 includes an end 37, which is an open end, on the side opposite to the conversion unit 31. The center position of the stubs 36 in the X-axis direction aligns with the center position of the slot 15 in the X-axis direction. An end 38 denotes the end of the second impedance transformation unit 34 in the X-axis direction. An end 39 denotes the end of the microstrip line 35 in the X-axis direction.

Figure 5:
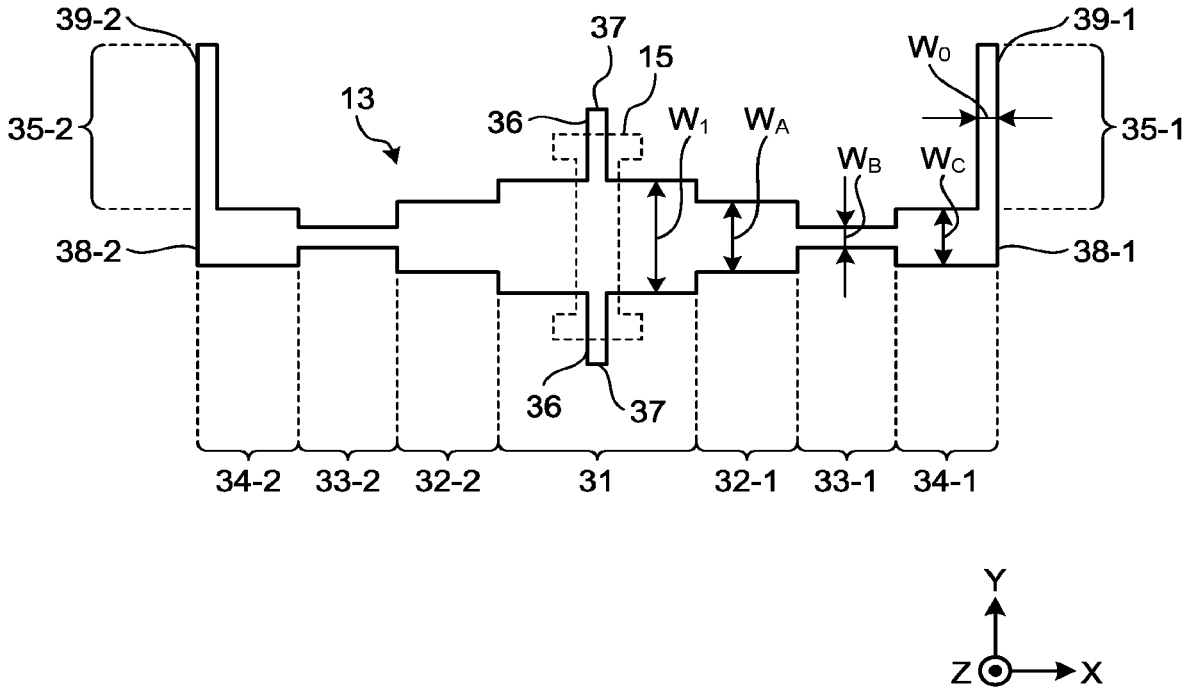
FIG. 5 is a plan view of a line conductor included in the waveguide microstrip line converter illustrated in FIG. 1.

FIG. 5 is a plan view of the line conductor 13 included in the waveguide microstrip line converter 10 illustrated in FIG. 1. FIG. 5 illustrates the slot 15 by a dotted line for reference purposes. The line conductor 13 is provided with the third section positioned on one side in the X-axis direction, i.e., on the positive X direction side, of the conversion unit 31, and is also provided with the third section positioned on the other side in the X-axis direction, i.e., on the negative X direction side, of the conversion unit 31. The third section positioned on the positive X direction side of the conversion unit 31 includes a first impedance transformation unit 32-1, a second impedance transformation unit 34-1, and a third impedance transformation unit 33-1. The third section positioned on the negative X direction side of the conversion unit 31 includes a first impedance transformation unit 32-2, a second impedance transformation unit 34-2, and a third impedance transformation unit 33-2. The first impedance transformation units 32-1 and 32-2, when they are not distinguished from each other, are collectively referred to as "first impedance transformation unit 32". The second impedance transformation units 34-1 and 34-2, when they are not distinguished from each other, are collectively referred to as "second impedance transformation unit 34". The third impedance transformation units 33-1 and 33-2, when they are not distinguished from each other, are collectively referred to as "third impedance transformation unit 33".

The line conductor 13 includes a microstrip line 35-1 extending in the Y-axis direction from the third section positioned on the positive X direction side of the conversion unit 31, and a microstrip line 35-2 extending in the Y-axis direction from the third section positioned on the negative X direction side of the conversion unit 31. The microstrip line 35-1 extends from the second impedance transformation unit 34-1 in the positive Y direction. The microstrip line 35-2 extends from the second impedance transformation unit 34-2 in the positive Y direction.

The microstrip line 35-1 is a first microstrip line included in the line conductor 13, and is positioned on one side in the X-axis direction, i.e., on the positive X direction side, of the conversion unit 31. The microstrip line 35-2 is a second microstrip line included in the line conductor 13, and is positioned on the other side in the X-axis direction, i.e., on the negative X direction side, of the conversion unit 31. The microstrip lines 35-1 and 35-2, when they are not distinguished from each other, are collectively referred to as "microstrip line 35".

The third section, positioned on the positive X direction side of the conversion unit 31, includes opposite ends in the X-axis direction. One of the opposite ends is an end of the first impedance transformation unit 32-1 on the negative X direction side and is connected to the conversion unit 31. The other of the opposite ends of the third section is an end 38-1 of the second impedance transformation unit 34-1 on the positive X direction side. The microstrip line 35-1 extends continuously from the end 38-1 in the Y-axis direction. In the planar configuration illustrated in FIG. 5, the end 38-1 and an end 39-1 of the microstrip line 35-1, positioned on the positive X direction side, form a single straight line in the Y-axis direction.

The third section, positioned on the negative X direction side of the conversion unit 31, includes opposite ends in the X-axis direction. One of the opposite ends is an end of the first impedance transformation unit 32-2 on the positive X direction side and is connected to the conversion unit 31. The other of the opposite ends of the third section is an end 38-2 of the second impedance transformation unit 34-2 on the negative X direction side. The microstrip line 35-2 extends continuously from the end 38-2 in the Y-axis direction. In the planar configuration illustrated in FIG. 5, the end 38-2 and an end 39-2 of the microstrip line 35-2, positioned on the negative X direction side, form a single straight line in the Y-axis direction.

In the first embodiment, the microstrip line 35 extends continuously from the end 38 of the third section in the Y-axis direction. This indicates that the microstrip line 35 is provided such that the end 39 of the microstrip line 35 and the end 38 of the third section form a single straight line. The ends 38-1 and 38-2, when they are not distinguished from each other, are collectively referred to as "end 38". The ends 39-1 and 39-2, when they are not distinguished from each other, are collectively referred to as "end 39".

The width of the line conductor 13 in the direction perpendicular to the direction of the transmission path is defined as a line width. The length of the line conductor 13 in the direction of the transmission path is defined as a line length. In the line conductor 13, the conversion unit 31 and the first, second, and third impedance transformation units 32, 34, and 33 constitute the transmission path extending in the X-axis direction. The line width of the conversion unit 31 and the first, second, and third impedance transformation units 32, 34, and 33 represents a width in the Y-axis direction. The line length of these units represents a length in the X-axis direction. In the line conductor 13, the microstrip line 35 constitutes the transmission path extending in the Y-axis direction. The line width of the microstrip line 35 represents a width in the X-axis direction. The line length of the microstrip line 35 represents a length in the Y-axis direction. The line width of the stub 36 represents a width in the X-axis direction. The line length of the stub 36 represents a length in the Y-axis direction.

The conversion unit 31, the first, second, and third impedance transformation units 32, 34, and 33, the microstrip line 35, and the stub 36 are formed from a metal foil or a metal plate being a single piece of metal member. The conversion unit 31, the first, second, and third impedance transformation units 32, 34, and 33, and the microstrip line 35 are formed in such a manner that the adjacent sections have different line widths from each other.

Where the line width of the microstrip line 35 is represented as a first line width $W_0$, and the line width of the conversion unit 31 is represented as a second line width $W_1$, $W_1$ is greater than $W_0$. That is, $W_1$ and $W_0$ satisfy the relation $W_1>W_0$. Where the wavelength of a high-frequency signal propagating through the line conductor 13 is represented as $\lambda$, the conversion unit 31 has a line length equivalent to $\lambda/2$. The microstrip line 35 is assumed to have any line length.

The first impedance transformation unit 32 has a line width $W_A$ that is greater than $W_0$ and smaller than $W_1$. That is, $W_A$, $W_0$, and $W_1$ satisfy the relation $W_1>W_A>W_0$. The third impedance transformation unit 33 has a line width $W_B$ that is equal to $W_0$ and smaller than $W_A$. That is, $W_B$, $W_0$, and $W_A$ satisfy the relation $W_A>W_B=W_0$. The second impedance transformation unit 34 has a line width $W_C$ that is greater than $W_B$ and greater than $W_0$. $W_C$ is smaller than $W_A$. That is, $W_C$, $W_B$, $W_0$, and $W_A$ satisfy the relation $W_A>W_C>W_B=W_0$.

$W_A$ and $W_C$ are greater than $W_0$. $W_A$ and $W_C$ are smaller than $W_1$. That is, $W_A$, $W_C$, $W_0$, and $W_1$ satisfy the relation $W_1>W_A>W_C>W_0$. Each of the first, second, and third impedance transformation units 32, 34, and 33 has a line length equivalent to $\lambda/4$. The stub 36 has a line length equivalent to $\lambda/4$.

Next, an operation of the waveguide microstrip line converter 10 is described with reference to FIGS. 1 to 5. A case where a high-frequency signal having propagated through the waveguide 14 is transmitted to the microstrip line 35 is described as an example.

Electromagnetic waves having propagated through the interior of the waveguide 14 reach the ground conductor 12. The electromagnetic waves having reached the ground conductor 12 propagate to the conversion unit 31 through the slot 15. It is assumed that the phrase "electromagnetic waves propagate to the conversion unit 31" also includes the meaning that energy of the electromagnetic waves is generated between the ground conductor 12 and the conversion unit 31. The electromagnetic waves having propagated to the conversion unit 31 propagate from the conversion unit 31 in the positive X direction and the negative X direction.

The electromagnetic waves, having propagated from the conversion unit 31 through the first impedance transformation unit 32-1, the third impedance transformation unit 33-1, and the second impedance transformation unit 34-1 in the positive X direction, then propagate through the microstrip line 35-1 in the positive Y direction. The electromagnetic waves, having propagated from the conversion unit 31 through the first impedance transformation unit 32-2, the third impedance transformation unit 33-2, and the second impedance transformation unit 34-2 in the negative X direction, then propagate through the microstrip line 35-2 in the positive Y direction. The waveguide microstrip line converter 10 outputs a high-frequency signal transmitted from the microstrip line 35-1 and the microstrip line 35-2 in the positive Y direction. The phase of a high-frequency signal output from the microstrip line 35-1 is opposite to the phase of a high-frequency signal output from the microstrip line 35-2.

There is a configuration in which a part of the conductor equivalent to the conversion unit 31 is provided with a fine gap to divide the line, and a high-frequency signal is transmitted by electromagnetic coupling. In this configuration, if the gap is improperly formed during machining, this may cause errors in the line length. In contrast to this, in the line conductor 13 according to the first embodiment, the respective sections from the conversion unit 31 to the microstrip line 35 are formed from a single piece of metal member. In the first embodiment, because it is unnecessary to form a gap on the line conductor 13, the problem of improper formation of a gap during machining can be avoided, and machining of the line conductor 13 can be facilitated.

The conversion unit 31, the first, second, and third impedance transformation units 32, 34, and 33, and the microstrip line 35 have a characteristic impedance corresponding to the line width. The characteristic impedance of the conversion unit 31 is represented as $Z_1$ corresponding to the line width $W_1$ of the conversion unit 31. The characteristic impedance of the microstrip line 35 is represented as $Z_0$ corresponding to the line width $W_0$ of the microstrip line 35. $Z_1$ is smaller than $Z_0$. That is, $Z_1$ and $Z_0$ satisfy the relation $Z_1<Z_0$. There is a significant difference in the line width between the conversion unit 31 and the microstrip line 35. For this reason, if the microstrip line 35 is brought directly adjacent to the conversion unit 31, characteristic impedance mismatch between the conversion unit 31 and the microstrip line 35 causes an increase in unwanted electromagnetic radiation, and leads to an increase in power loss.

The first, second, and third impedance transformation units 32, 34, and 33 perform impedance matching between the conversion unit 31 and the microstrip line 35. The characteristic impedance of the first impedance transformation unit 32 is represented as $Z_A$ corresponding to the line width $W_A$ of the first impedance transformation unit 32. $Z_A$ is smaller than $Z_0$ and is greater than $Z_1$. That is, $Z_A$, $Z_0$, and $Z_1$ satisfy the relation $Z_1<Z_A<Z_0$.

The characteristic impedance of the third impedance transformation unit 33 is represented as $Z_B$ corresponding to the line width $W_B$ of the third impedance transformation unit 33. $Z_B$ is equal to $Z_0$ and is greater than $Z_A$. That is, $Z_B$, $Z_0$, and $Z_A$ satisfy the relation $Z_A<Z_B=Z_0$. The characteristic impedance of the second impedance transformation unit 34 is represented as $Z_C$ corresponding to the line width $W_C$ of the second impedance transformation unit 34. $Z_C$ is smaller than $Z_B$ and smaller than $Z_0$, and is greater than $Z_A$. That is, $Z_B$, $Z_B$, $Z_0$, and $Z_A$ satisfy the relation $Z_A<Z_C<Z_B=Z_0$.

In the first embodiment, the waveguide microstrip line converter 10 is provided with the first and second impedance transformation units 32 and 34, each of which has an increased line width relative to the line width of the microstrip line 35, in order to obtain impedance matching between the conversion unit 31 and the microstrip line 35. The waveguide microstrip line converter 10 can reduce power loss by impedance matching between the conversion unit 31 and the microstrip line 35.

The third impedance transformation unit 33 and the second impedance transformation unit 34 have a function of reducing the impedance mismatch caused by the difference in the line width between the first impedance transformation unit 32 and the microstrip line 35. The line conductor 13 includes the first, second, and third impedance transformation units 32, 34, and 33 that are sections having stepwise different line widths, so that it is possible to moderate the steep change in impedance during transmission of electromagnetic waves. Due to this configuration, the waveguide microstrip line converter 10 can effectively reduce power loss. The waveguide microstrip line converter 10 can moderate the change in impedance of the line conductor 13, and is thus capable of handling signals in a wider frequency band.

It is permissible that the third impedance transformation unit 33 has a line width different from the line width of the microstrip line 35. It is sufficient if the line width $W_B$ of the third impedance transformation unit 33 satisfies $W_A>W_B$ and $W_C>W_B$. The line width $W_B$ may be different from the line width $W_0$ of the microstrip line 35. The number of impedance transformation units, which are the sections with an increased line width relative to the microstrip line 35, is not limited to two, but may be one or may be three or more.

In the first embodiment, the microstrip line 35 extends from the end 38 of the second impedance transformation unit 34 in the Y-axis direction such that the end 38 and the end 39 of the microstrip line 35 form a single straight line. Between the second impedance transformation unit 34 and the microstrip line 35, a portion with irregular line widths between the second impedance transformation unit 34 and the microstrip line 35 is integral with the bent part of the transmission path.

If the microstrip line 35 having a constant line width includes a bent part formed of the portion extending in the X-axis direction and the portion extending in the Y-axis direction, unwanted electromagnetic radiation may occur at the portion with irregular line widths between the second impedance transformation unit 34 and the microstrip line 35 and at the bent part of the transmission path. The waveguide microstrip line converter 10, in which the portion with irregular line widths is integral with the bent part of the transmission path, can reduce the number of locations where unwanted electromagnetic radiation may occur. Thus, the waveguide microstrip line converter 10 can reduce power loss caused by unwanted electromagnetic radiation in the configuration to transmit a high-frequency signal in a Y-axis direction perpendicular to an X-axis direction that is the transmission direction from the conversion unit 31.

In FIG. 5, the center position of the stubs 36 in the X-axis direction aligns with the center position of the slot 15 in the X-axis direction. In this case, because the line conductor 13 is symmetric with respect to the center of the slot 15, power does not propagate to the two stubs 36. However, the center position of the slot 15 in the X-axis direction and the center position of the stubs 36 in the X-axis direction may become misaligned due to manufacturing errors or the like of the waveguide microstrip line converter 10.

Due to misalignment between the line conductor 13 and the slot 15, an electric field is generated in the stubs 36. Because the end 37 of the stub 36 is an open end, the boundary condition that the electric field is zero at a connection portion of the stub 36 and the conversion unit 31 is satisfied. This secures electrical symmetry in the line conductor 13, so that high-frequency signals output from two microstrip lines 35 have opposite phases to each other. In the manner as described above, the waveguide microstrip line converter 10 is provided with the stubs 36, and can thus reduce the influence of misalignment between the line conductor 13 and the slot 15 on the high-frequency signals. By securing electrical symmetry using the two stubs 36, the line conductor 13 can reduce variations in the phase of a high-frequency signal on the microstrip lines 35-1 and 35-2. It is permissible that the line conductor 13 is provided with only one stub 36. In the case where the line conductor 13 is provided with one stub 36, it is permissible that the stub 36 is provided at either an end of the conversion unit 31 positioned on the positive Y direction side or an end of the conversion unit 31 positioned on the negative Y direction side.

The waveguide microstrip line converter 10 is also capable of transmitting a high-frequency signal having propagated through the microstrip line 35 to the waveguide 14. A high-frequency signal to be transmitted in the negative Y direction is input to the microstrip line 35-1 and the microstrip line 35-2. The phase of a high-frequency signal input to the microstrip line 35-1 is opposite to the phase of a high-frequency signal input to the microstrip line 35-2. The waveguide microstrip line converter 10 can also reduce power loss in propagation of a high-frequency signal from the microstrip line 35 to the waveguide 14 similarly to the propagation of a high-frequency signal from the waveguide 14 to the microstrip line 35.

The conversion unit 31 has the line width $W_1$ smaller than the longer side of the opening end 16 and smaller than the length of the slot 15 in the Y-axis direction. If sufficient electromagnetic coupling between the waveguide 14 and the conversion unit 31 is secured, the waveguide microstrip line converter 10 can obtain high power conversion efficiency between the waveguide 14 and the conversion unit 31 regardless of physical dimensions of the waveguide 14 and the conversion unit 31.

According to the first embodiment, the waveguide microstrip line converter 10 is provided with the first, second, and third impedance transformation units 32, 34, and 33 that perform impedance matching between the conversion unit 31 and the microstrip line 35, and can thereby reduce electromagnetic radiation and reduce power loss. The waveguide microstrip line converter 10 is provided with the slot 15 with an H-shape, so that electromagnetic coupling is strengthened immediately below the conversion unit 31, and thus the waveguide microstrip line converter 10 can more efficiently convert power between the waveguide 14 and the line conductor 13. Due to this configuration, the waveguide microstrip line converter 10 can obtain high electric performance without provision of a through hole in the dielectric substrate 11.

Further, in the waveguide microstrip line converter 10, the microstrip lines 35-1 and 35-2 extend in the Y-axis direction continuously from the end 38-1 of the third section positioned on the positive X direction side and from the end 38-2 of the third section positioned on the negative X direction side, respectively. While reducing unwanted electromagnetic radiation, the waveguide microstrip line converter 10 can achieve a configuration in which the microstrip line 35 extends in the longer-side direction of the opening end 16. Due to this configuration, the waveguide microstrip line converter 10 can obtain high electric performance.

Because the waveguide microstrip line converter 10 does not require a through hole in the dielectric substrate 11, it is possible to simplify the manufacturing processes and reduce the manufacturing costs due to omission of machining to form the through hole. The waveguide microstrip line converter 10 can also avoid degradation in electric performance caused by breakage of the through hole, and thus can improve the reliability and obtain stable electric performance. In a case where the waveguide microstrip line converter 10 is used in a feed circuit of an antenna device, the antenna device can obtain stable transmission power and reception power. Due to the configuration described above, the waveguide microstrip line converter 10 achieves the effects of obtaining stable and high electric performance while making it possible to improve the reliability.

In the waveguide microstrip line converter 10, unwanted electromagnetic radiation may occur from the slot 15 or from a portion of the line conductor 13 with irregular line widths. It is possible for the waveguide microstrip line converter 10 to adjust the phase of electromagnetic waves to be radiated by adjusting the dimensions of the slot 15 or the dimensions of each section of the line conductor 13. It is permissible that unwanted electromagnetic radiation in a specific direction from the waveguide microstrip line converter 10, that is the positive Z direction, is reduced by adjusting the phase of electromagnetic waves to be radiated. It is also permissible to adjust electromagnetic waves to be radiated so as to spread out the electromagnetic radiation evenly in all directions so that imbalance in the electromagnetic radiation in which electromagnetic radiation becomes intense in a specific direction than any other directions is reduced. Due to the adjustment as described above, the waveguide microstrip line converter 10 can also obtain high electric performance.

Figure 6:
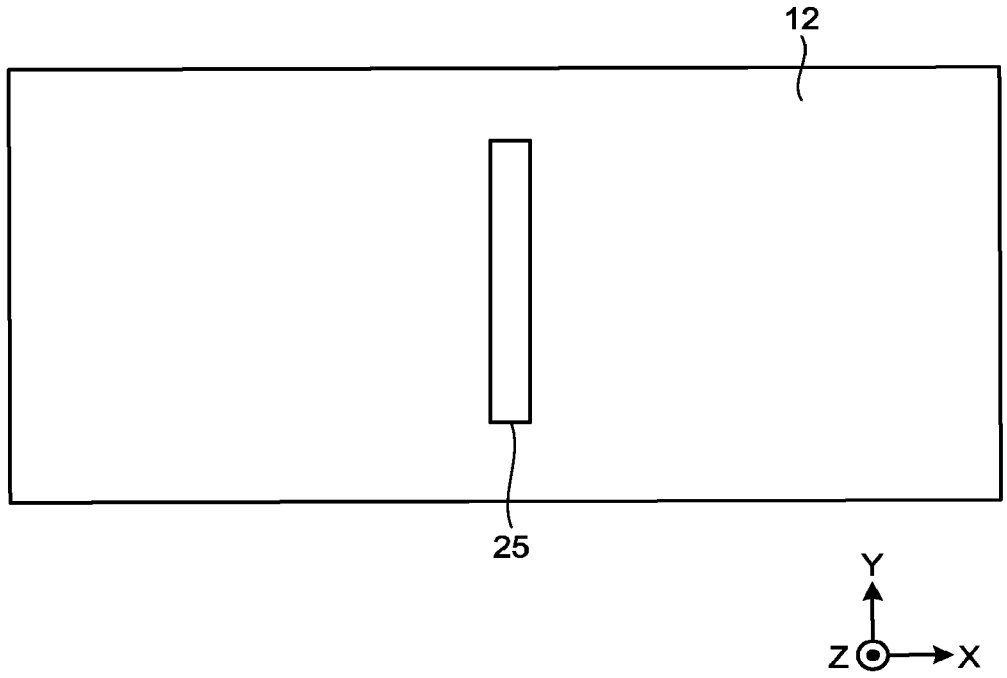
FIG. 6 is a diagram illustrating a modification of a slot included in the waveguide microstrip line converter illustrated in FIG. 1.

It is permissible that the waveguide microstrip line converter 10 includes a slot with any shape as long as electromagnetic radiation is at a permissible level. FIG. 6 is a diagram illustrating a modification of a slot included in the waveguide microstrip line converter 10 illustrated in FIG. 1. A slot 25 according to the modification has a rectangular planar shape including longer sides parallel to the Y-axis and shorter sides parallel to the X-axis. In order to achieve electric performance equivalent to the electric performance obtained by using the slot 15 with an H-shape, the slot 25 may have longer sides whose length is greater than the width of the slot 15 in the Y-axis direction.

Figure 7:
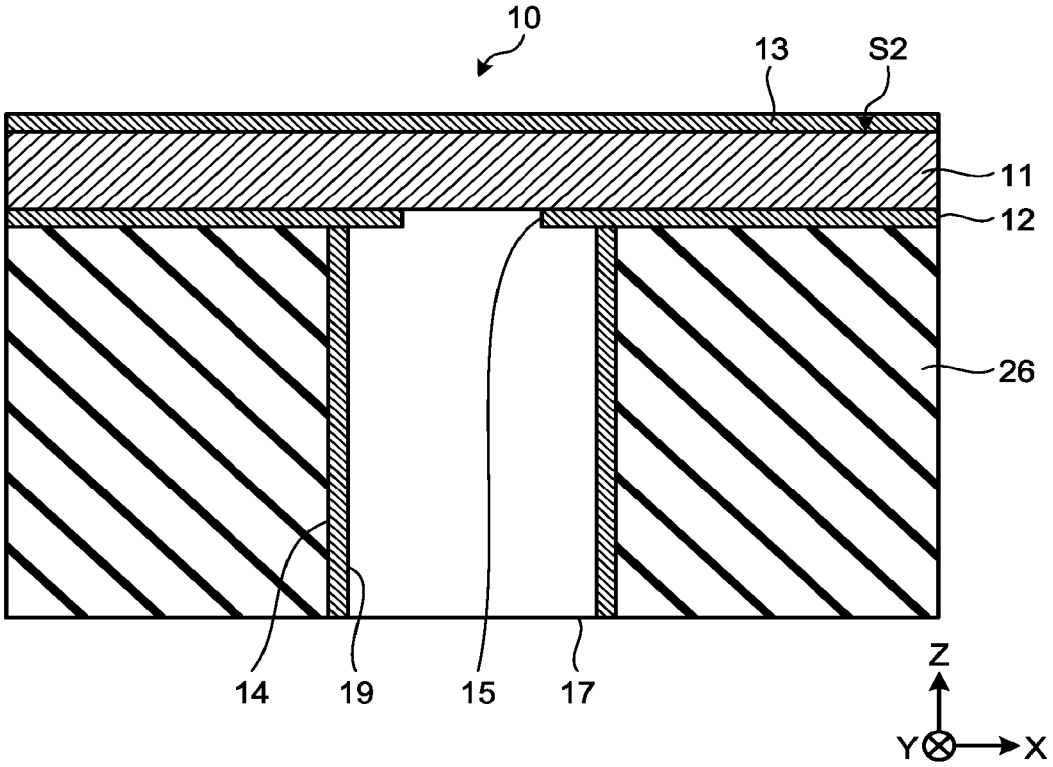
FIG. 7 is a cross-sectional diagram illustrating one application example of the waveguide microstrip line converter according to the first embodiment.

FIG. 7 is a cross-sectional diagram illustrating one application example of the waveguide microstrip line converter 10 according to the first embodiment. In the application example illustrated in FIG. 7, the waveguide microstrip line converter 10 is mounted on a dielectric substrate 26. FIG. 7 illustrates a cross-sectional configuration having the dielectric substrate 26 added to the cross-sectional configuration illustrated in FIG. 2. The dielectric substrate 26 is a flat plate member made of a resin material.

The ground conductor 12 is stacked on the upper surface of the dielectric substrate 26. The waveguide 14 is provided to pass through the dielectric substrate 26 between the upper surface and the rear surface. The input-output end 17 is open to the rear side of the dielectric substrate 26. It is permissible that the waveguide microstrip line converter 10 is provided with a plurality of through holes formed to pass through the dielectric substrate 26 between the upper surface and the rear surface, instead of the waveguide 14. The through holes are located along the shape such as a rectangular shape or an oval shape. Even when the through holes are provided, the waveguide microstrip line converter 10 is still capable of transmitting a high-frequency signal in the same manner as when the waveguide 14 is provided.

Figure 8:
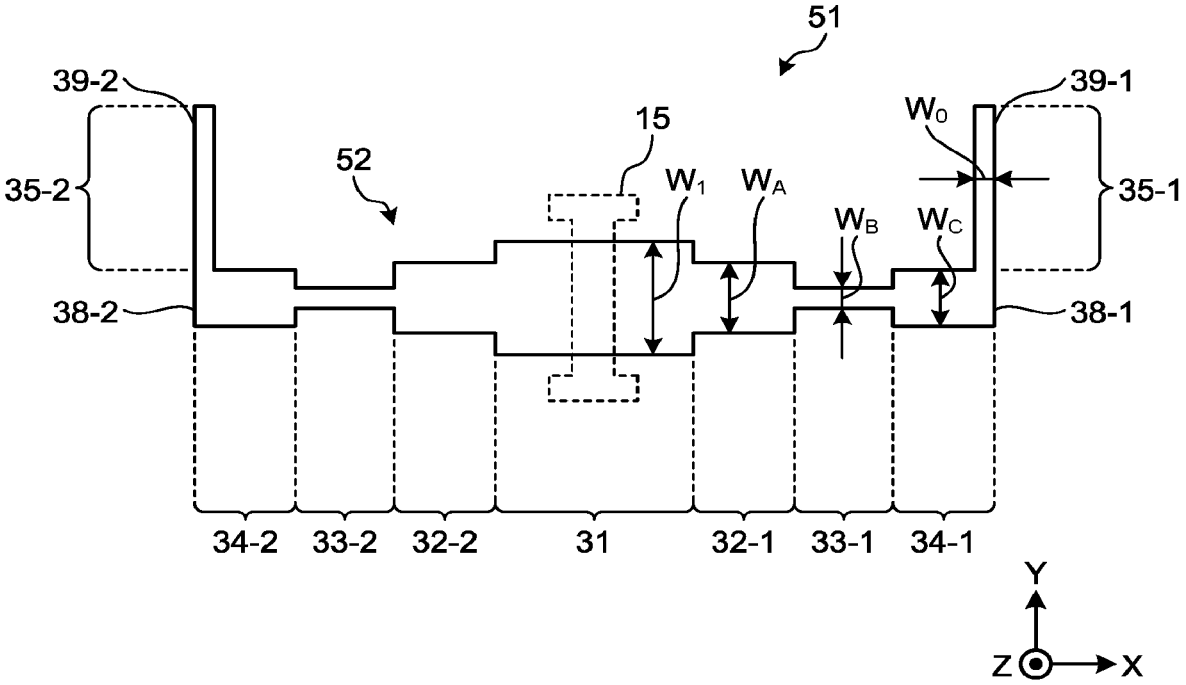
FIG. 8 is a plan view of a line conductor included in a waveguide microstrip line converter according to a first modification of the first embodiment.

FIG. 8 is a plan view of a line conductor 52 included in a waveguide microstrip line converter 51 according to a first modification of the first embodiment. FIG. 8 illustrates the slot 15 by a dotted line for reference purposes. The waveguide microstrip line converter 51 has a similar configuration to the waveguide microstrip line converter 10, except that the line conductor 52 is not provided with the stubs 36.

When misalignment between the line conductor 52 and the slot 15 in the X-axis direction can be reduced and consequently variations in the phase of a high-frequency signal on the microstrip lines 35-1 and 35-2 can be reduced, the stubs 36 can be omitted. Due to this configuration, the waveguide microstrip line converter 51 can obtain stable and high electric performance similarly to the waveguide microstrip line converter 10 described above. In addition to that, when a high-frequency signal is transmitted regardless of whether there are variations in the phase of a high-frequency signal on the microstrip lines 35-1 and 35-2, the stubs 36 can be omitted. In a modification other than the first modification of the first embodiment and in second to fifth embodiments described later, the stubs 36 can be omitted similarly to the first modification of the first embodiment.

Figure 9:
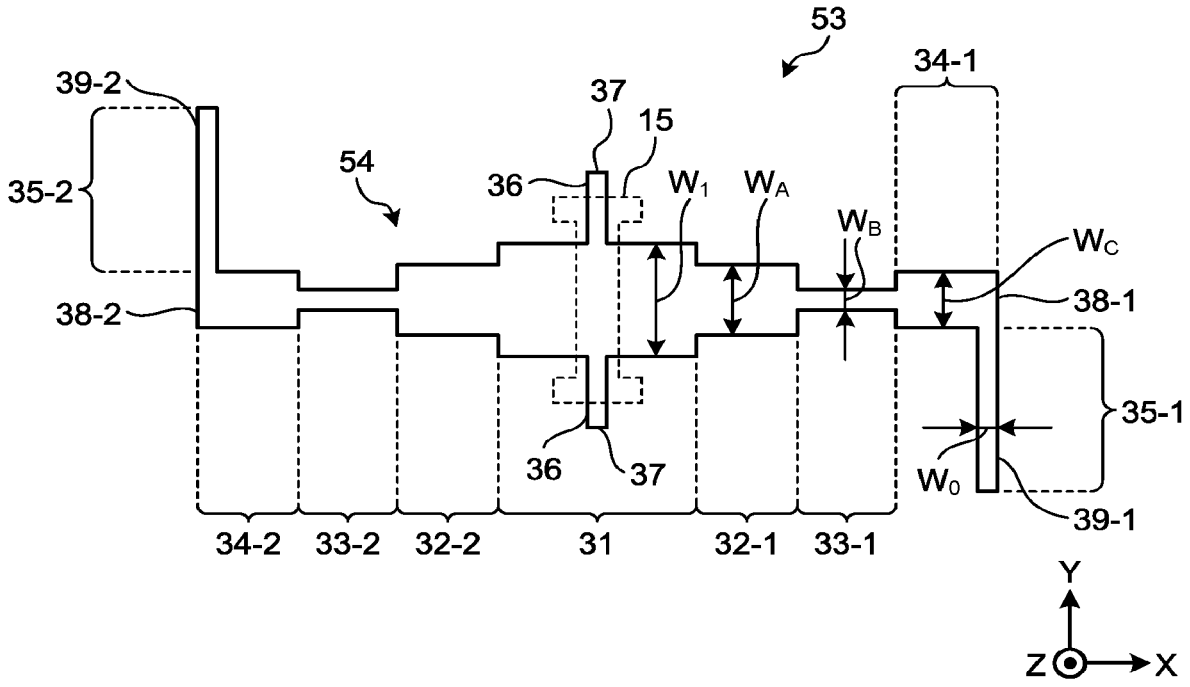
FIG. 9 is a plan view of a line conductor included in a waveguide microstrip line converter according to a second modification of the first embodiment.

FIG. 9 is a plan view of a line conductor 54 included in a waveguide microstrip line converter 53 according to a second modification of the first embodiment. FIG. 9 illustrates the slot 15 by a dotted line for reference purposes. The waveguide microstrip line converter 53 has a similar configuration to the waveguide microstrip line converter 10, except that two microstrip lines 35 in the line conductor 54 extend from the second impedance transformation unit 34 in opposite directions to each other. The microstrip line 35-1 extends from the second impedance transformation unit 34-1 in the negative Y direction. The microstrip line 35-2 extends from the second impedance transformation unit 34-2 in the positive Y direction.

Electromagnetic waves, having propagated from the conversion unit 31 through the first impedance transformation unit 32-1, the third impedance transformation unit 33-1, and the second impedance transformation unit 34-1 in the positive X direction, are then transmitted through the microstrip line 35-1 in the negative Y direction. Electromagnetic waves, having propagated from the conversion unit 31 through the first impedance transformation unit 32-2, the third impedance transformation unit 33-2, and the second impedance transformation unit 34-2 in the negative X direction, are then transmitted through the microstrip line 35-2 in the positive Y direction. A high-frequency signal to be transmitted in the positive Y direction is input to the microstrip line 35-1. A high-frequency signal to be transmitted in the negative Y direction is input to the microstrip line 35-2. The waveguide microstrip line converter 53 can obtain stable and high electric performance similarly to the waveguide microstrip line converter 10 described above.

Figure 10:
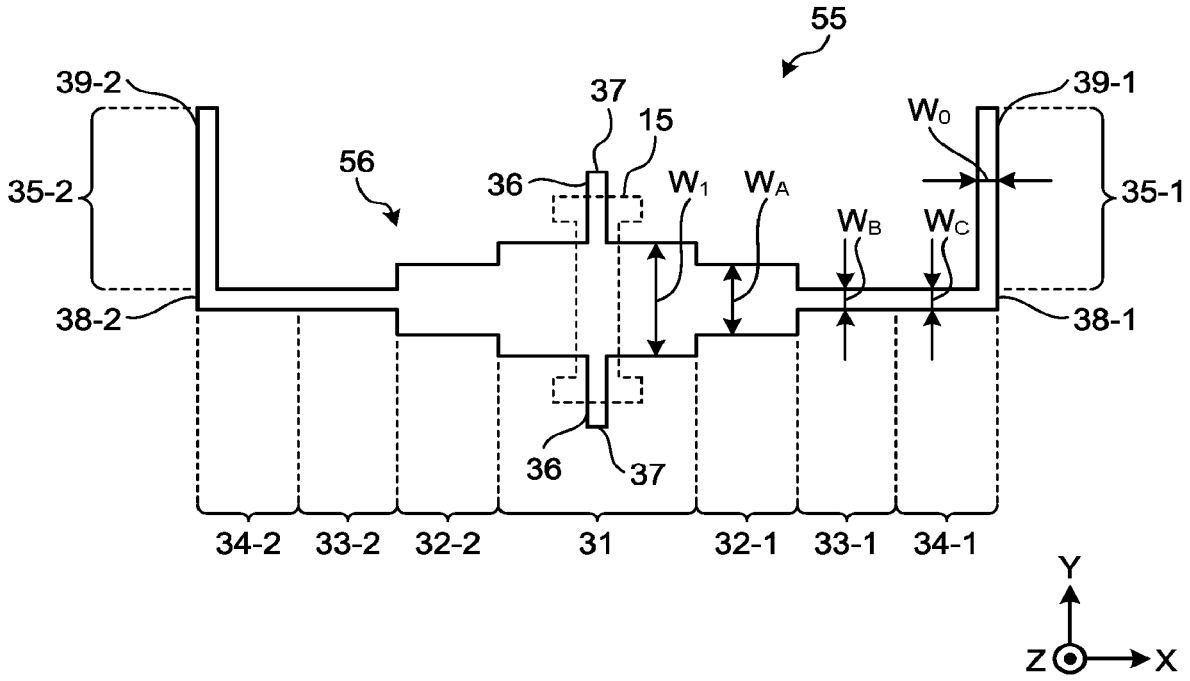
FIG. 10 is a plan view of a line conductor included in a waveguide microstrip line converter according to a third modification of the first embodiment.

FIG. 10 is a plan view of a line conductor 56 included in a waveguide microstrip line converter 55 according to a third modification of the first embodiment. FIG. 10 illustrates the slot 15 by a dotted line for reference purposes. The waveguide microstrip line converter 55 has a similar configuration to the waveguide microstrip line converter 10, except that the second impedance transformation unit 34 has the line width $W_C$ equal to the line width $W_B$ of the third impedance transformation unit 33 in the line conductor 56.

The third impedance transformation unit 33 has the line width $W_B$ equal to the line width $W_0$ of the microstrip line 35. The line width $W_A$ of the first impedance transformation unit 32, the line width $W_B$ of the third impedance transformation unit 33, the line width $W_C$ of the second impedance transformation unit 34, and the line width $W_0$ of the microstrip line 35 satisfy the relation $W_A > W_B = W_C = W_0$.

In the waveguide microstrip line converter 55, the line width of the second impedance transformation unit 34 is equal to the line width of the third impedance transformation unit 33. Thus, impedance matching between the second impedance transformation unit 34 and the third impedance transformation unit 33 is not performed. Provided that electromagnetic radiation is at a permissible level, it is permissible that the transformation units of the third section, which are adjacent to each other, have equal line width similarly to the waveguide microstrip line converter 55.

The line width of the second impedance transformation unit 34 and the line width of the third impedance transformation unit 33 are equal to the line width of the microstrip line 35, so that a high-frequency signal propagates through the second impedance transformation unit 34 and the third impedance transformation unit 33 in the same manner as the microstrip line 35. It is permissible that the line width of the second impedance transformation unit 34 and the line width of the third impedance transformation unit 33 are different from the line width of the microstrip line 35.

In the waveguide microstrip line converter 55, it is permissible to adjust the position of the end 38 in the X-axis direction by adjusting the line length of the second impedance transformation unit 34 or the line length of the third impedance transformation unit 33. The amplitude and the phase of electromagnetic waves to be radiated are adjusted by adjusting the position of the end 38, so that the waveguide microstrip line converter 55 can reduce electromagnetic waves to be radiated. The waveguide microstrip line converter 55 can obtain stable and high electric performance similarly to the waveguide microstrip line converter 10 described above.

Second Embodiment

Figure 11:
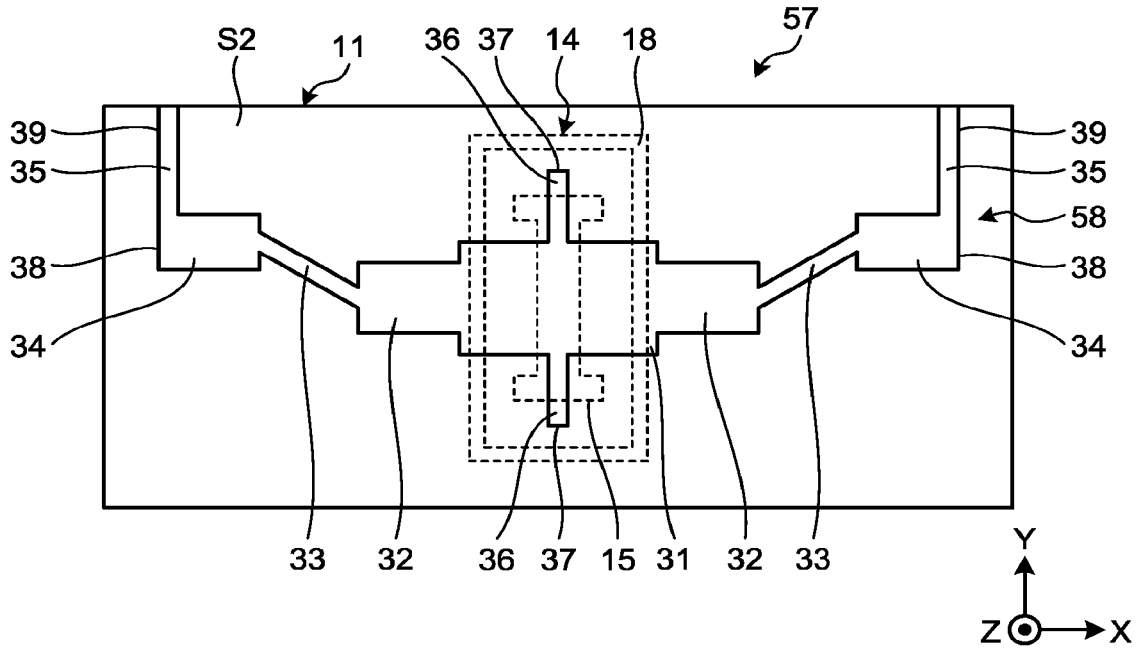
FIG. 11 is a top view illustrating an external configuration of a waveguide microstrip line converter according to a second embodiment of the present invention.

FIG. 11 is a top view illustrating an external configuration of a waveguide microstrip line converter 57 according to a second embodiment of the present invention. In a third section of the waveguide microstrip line converter 57, the first and second impedance transformation units 32 and 34 extend in the X-axis direction, while the third impedance transformation unit 33 extends in a diagonal direction between the X-axis direction and the Y-axis direction. In the second embodiment, constituent elements identical to those of the first embodiment are denoted by like reference signs, and configurations different from those of the first embodiment are mainly described.

Figure 12:
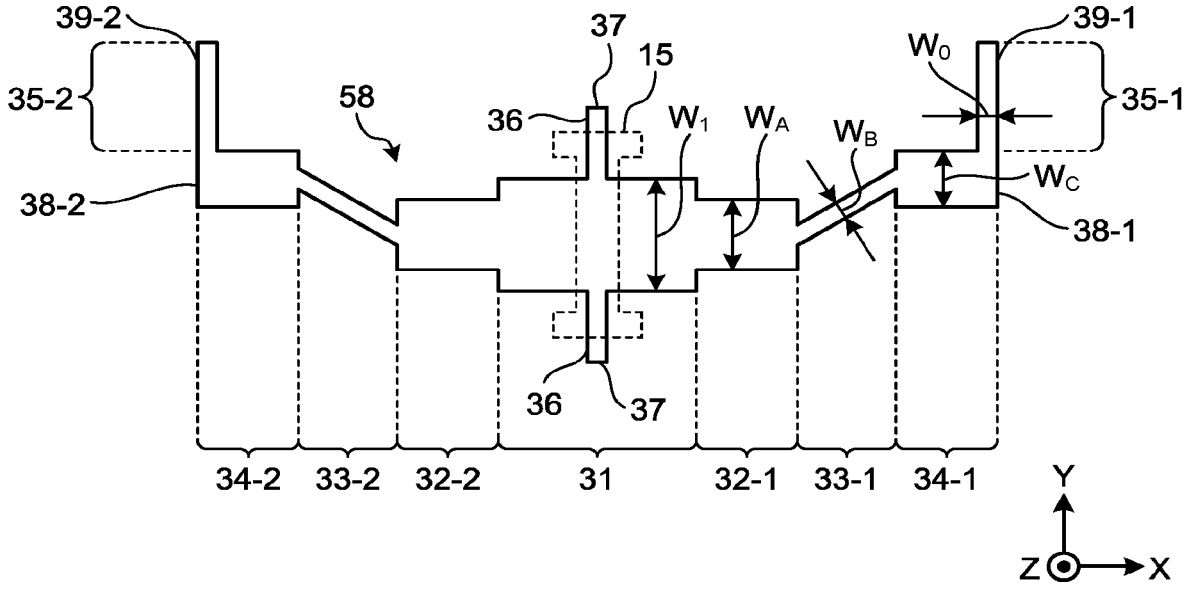
FIG. 12 is a plan view of a line conductor included in the waveguide microstrip line converter illustrated in FIG. 11.

FIG. 12 is a plan view of a line conductor 58 included in the waveguide microstrip line converter 57 illustrated in FIG. 11. FIG. 12 illustrates the slot 15 by a dotted line for reference purposes. The first impedance transformation unit 32-1 is positioned on the positive X direction side of the conversion unit 31. The third impedance transformation unit 33-1 extends from the first impedance transformation unit 32-1 in a diagonal direction between the positive X direction and the positive Y direction. The center of the second impedance transformation unit 34-1 in the Y-axis direction is shifted toward the positive Y direction side relative to the center of the first impedance transformation unit 32-1 in the Y-axis direction. The third impedance transformation unit 33-1 constitutes a transmission path extending in a diagonal direction between the X-axis direction and the Y-axis direction. The line width of the third impedance transformation unit 33-1 represents a width in the direction perpendicular to the diagonal direction. The line length of the third impedance transformation unit 33-1 represents a length in the diagonal direction. The third impedance transformation unit 33-1 is assumed to have any line length.

The first impedance transformation unit 32-2 is positioned on the negative X direction side of the conversion unit 31. The third impedance transformation unit 33-2 extends from the first impedance transformation unit 32-2 in a diagonal direction between the negative X direction and the positive Y direction. The center of the second impedance transformation unit 34-2 in the Y-axis direction is shifted toward the positive Y direction side relative to the center of the first impedance transformation unit 32-2 in the Y-axis direction. The third impedance transformation unit 33-2 constitutes a transmission path extending in a diagonal direction between the X-axis direction and the Y-axis direction. The line width of the third impedance transformation unit 33-2 represents a width in the direction perpendicular to the diagonal direction. The line length of the third impedance transformation unit 33-2 represents a length in the diagonal direction. The third impedance transformation unit 33-2 is assumed to have any line length.

In the waveguide microstrip line converter 57, the third impedance transformation unit 33, having the smallest line width among the first, second, and third impedance transformation units 32, 34, and 33, constitutes the transmission path extending in the diagonal direction. The waveguide microstrip line converter 57 can more easily achieve a configuration in which the third section includes a transmission path extending in the diagonal direction, as compared to the case where the first impedance transformation unit 32 or the second impedance transformation unit 34 constitutes the transmission path extending in the diagonal direction.

In the waveguide microstrip line converter 57, it is permissible to adjust the position of the end 38 in the X-axis direction by adjusting the line length of the third impedance transformation unit 33. The amplitude and the phase of electromagnetic waves to be radiated are adjusted by adjusting the position of the end 38, so that the waveguide microstrip line converter 57 can reduce electromagnetic waves to be radiated.

In the waveguide microstrip line converter 57, the position of the second impedance transformation unit 34 is shifted in the positive Y direction, in contrast to the configuration according to the first embodiment. In the configuration in which the microstrip line 35 extends from the second impedance transformation unit 34 in the positive Y direction, the position of the second impedance transformation unit 34 is shifted in the positive Y direction, so that the waveguide microstrip line converter 57 can reduce the length of the transmission path from the conversion unit 31 to the microstrip line 35. Power loss attributable to material properties of the dielectric substrate 11 and power loss attributable to the conductivity of the line conductor 58 are substantially proportional to the line length of the line conductor 58 in its entirety. Accordingly, the waveguide microstrip line converter 57 can reduce the length of the transmission path from the conversion unit 31 to the end of the microstrip line 35 positioned on the positive Y direction side, and can accordingly reduce power loss due to transmission of a high-frequency signal.

The waveguide microstrip line converter 57 can reduce power loss due to unwanted electromagnetic radiation similarly to the waveguide microstrip line converter 10 according to the first embodiment. The waveguide microstrip line converter 57 can improve the reliability and can also obtain stable electric performance similarly to the waveguide microstrip line converter 10 according to the first embodiment. Accordingly, the waveguide microstrip line converter 57 achieves the effects of obtaining stable and high electric performance while making it possible to improve the reliability.

In the waveguide microstrip line converter 57, one or both of the microstrip lines 35-1 and 35-2 may extend respectively from the second impedance transformation units 34-1 and 34-2 in the negative Y direction. In this case, the third impedance transformation unit 33 within the third section adjacent to the microstrip line 35 extending in the negative Y direction may extend from the first impedance transformation unit 32 in a diagonal direction between the X-axis direction and the negative Y direction. Due to this configuration, the waveguide microstrip line converter 57 can reduce the length of the transmission path.

Third Embodiment

Figure 13:
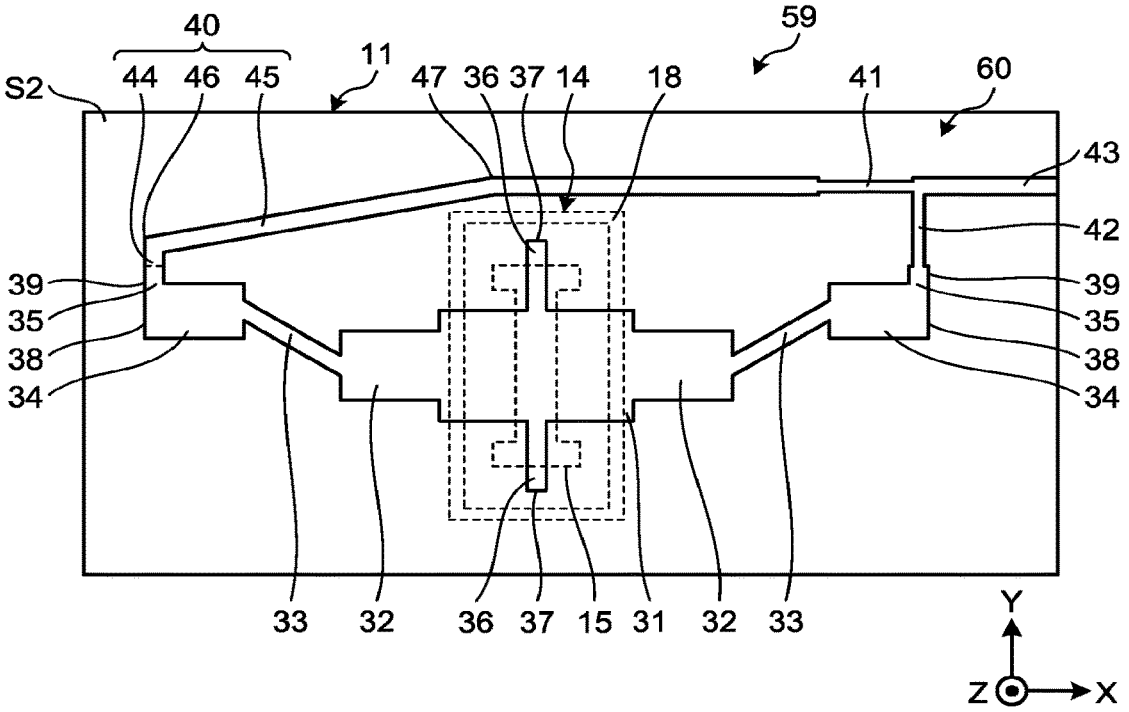
FIG. 13 is a top view illustrating an external configuration of a waveguide microstrip line converter according to a third embodiment of the present invention.

FIG. 13 is a top view illustrating an external configuration of a waveguide microstrip line converter 59 according to a third embodiment of the present invention. A line conductor 60 of the waveguide microstrip line converter 59 includes a fifth section to which a transmission path including one microstrip line 35 and a transmission path including another microstrip line 35 are connected. The fifth section serves as a section through which a high-frequency signal is input from the outside of the waveguide microstrip line converter 59 to the line conductor 60 and through which a high-frequency signal is output from the line conductor 60 to the outside of the waveguide microstrip line converter 59. In the third embodiment, constituent elements identical to those of the first to second embodiments are denoted by like reference signs, and configurations different from those of the first to second embodiments are mainly described.

In the line conductor 60 of the waveguide microstrip line converter 59, the conversion unit 31, the first, second, and third impedance transformation units 32, 34, and 33, and the microstrip line 35 are configured similarly to those in the line conductor 58 according to the above second embodiment. The line conductor 60 further includes a microstrip line 40, a fourth impedance transformation unit 41, a fifth impedance transformation unit 42, and a microstrip line 43 that is the fifth section.

Figure 14:
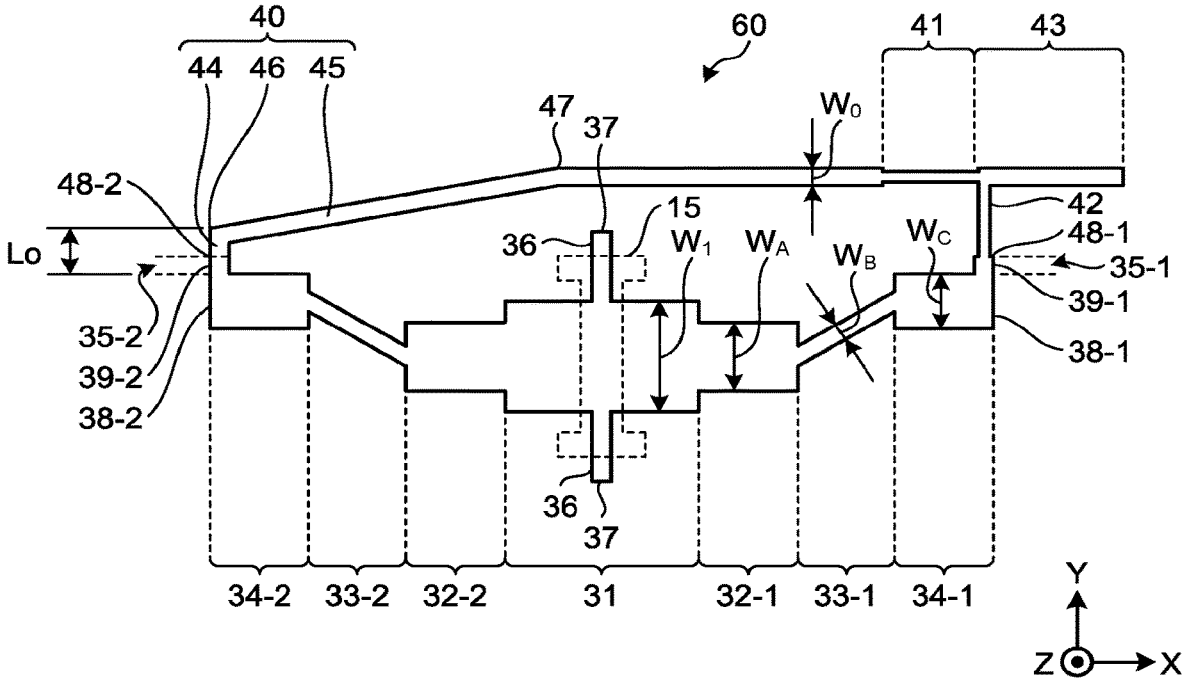
FIG. 14 is a plan view of a line conductor included in the waveguide microstrip line converter illustrated in FIG. 13.

FIG. 14 is a plan view of the line conductor 60 included in the waveguide microstrip line converter 59 illustrated in FIG. 13. FIG. 14 illustrates the slot 15 by a dotted line for reference purposes. The microstrip line 40 is a fourth section provided continuously from the microstrip line 35-2 and is a third microstrip line provided in the line conductor 60.

The microstrip line 35-2 is a first section extending from the second impedance transformation unit 34-2 positioned on one side in the X-axis direction, i.e., on the negative X direction side, of the conversion unit 31. The microstrip line 40 includes a first area 44 extending continuously from the microstrip line 35-2 in the positive Y direction, a second area 45 extending from the first area 44 toward the other side in the X-axis direction, i.e., in the positive X direction, and a bent portion 46 between the first area 44 and the second area 45. A bent portion 47 that forms an obtuse angle is provided in the second area 45.

The first area 44 is a portion between the microstrip line 35-2 and the bent portion 46, and extends in the Y-axis direction. The section of the second area 45 between the bent portion 46 and the bent portion 47 extends in a diagonal direction slightly inclined relative to the X-axis direction such that this section extends in the positive Y direction as this section extends in the positive X direction. The section of the second area 45, positioned on the positive X direction side of the bent portion 47, extends in the X-axis direction. The line width of the first area 44 represents a width in the X-axis direction. The line length of the first area 44 represents a length in the Y-axis direction. The line width of the section of the second area 45 between the bent portion 46 and the bent portion 47 represents a width in the direction perpendicular to the diagonal direction, and the line length of this section represents a length in the diagonal direction. The line width of the section of the second area 45, positioned on the positive X direction side of the bent portion 47, represents a width in the Y-axis direction, and the line length of this section represents a length in the X-axis direction.

The fourth impedance transformation unit 41 is positioned on the positive X direction side of the second area 45. The fourth impedance transformation unit 41 performs impedance matching between the microstrip line 43 and the microstrip lines 35-2 and 40. The fourth impedance transformation unit 41 extends in the X-axis direction. The line width of the fourth impedance transformation unit 41 represents a width in the Y-axis direction. The line length of the fourth impedance transformation unit 41 represents a length in the X-axis direction.

The fifth impedance transformation unit 42 is positioned on the positive Y direction side of the microstrip line 35-1. The fifth impedance transformation unit 42 performs impedance matching between the microstrip line 43 and the microstrip line 35-1. The fifth impedance transformation unit 42 extends in the Y-axis direction. The line width of the fifth impedance transformation unit 42 represents a width in the X-axis direction. The line length of the fifth impedance transformation unit 42 represents a length in the Y-axis direction.

The microstrip line 43 extends from the fourth impedance transformation unit 41 in the positive X direction. An end portion of the microstrip line 43 positioned on the negative X direction side and an end portion of the fifth impedance transformation unit 42 positioned on the positive Y direction side are connected perpendicularly to each other. The line width of the microstrip line 43 represents a width in the Y-axis direction. The line length of the microstrip line 43 represents a length in the X-axis direction.

In the waveguide microstrip line converter 59, a transmission path of the microstrip line 35-1 and the fifth impedance transformation unit 42 and a transmission path of the microstrip line 35-2, the microstrip line 40, and the fourth impedance transformation unit 41 are connected to a single transmission path that is the microstrip line 43. In the waveguide microstrip line converter 59, a looped transmission path is constituted by the conversion unit 31, the first to fifth impedance transformation units 32, 34, 33, 41, and 42, and the microstrip lines 35 and 40.

The first area 44 and the second area 45 of the microstrip line 40 have the line width $W_0$ equal to the line width of the microstrip line 35. Where the wavelength of a high-frequency signal to be transmitted through the line conductor 60 is represented as λ, a total line length $L_0$ of the microstrip line 35-2 and the first area 44 is approximately equivalent to λ/4 or equal to or smaller than λ/4. The microstrip line 35-2 has any line length such that a total line length of the microstrip line 35-2 and the first area 44 satisfies $L_0\lambda\leq/4$. The line length of the microstrip line 35-1 is equal to the line length of the microstrip line 35-2.

The microstrip line 43 is assumed to have any line width and any line length. Each of the fourth impedance transformation unit 41 and the fifth impedance transformation unit 42 has a line length equivalent to λ/4. The line width of each of the fourth impedance transformation unit 41 and the fifth impedance transformation unit 42 is smaller than the line width $W_0$ of each of the microstrip lines 35 and 40.

Next, an operation of the waveguide microstrip line converter 59 is described with reference to FIG. 14. A case where a high-frequency signal having propagated through the waveguide 14 is transmitted to the microstrip line 43 is described as an example. A high-frequency signal propagates from the waveguide 14 to the microstrip lines 35-1 and 35-2 in the same manner as in the second embodiment. The phase of a high-frequency signal on a boundary 48-2 between the microstrip line 35-2 and the microstrip line 40 is opposite to the phase of a high-frequency signal on a boundary 48-1 between the microstrip line 35-1 and the fifth impedance transformation unit 42.

A high-frequency signal having passed through the boundary 48-2 propagates to the microstrip line 43 via the microstrip line 40 and the fourth impedance transformation unit 41. A high-frequency signal having passed through the boundary 48-1 propagates to the microstrip line 43 via the fifth impedance transformation unit 42. The waveguide microstrip line converter 59 outputs a high-frequency signal to be transmitted in the positive X direction from the microstrip line 43. The line length of the microstrip line 40 is set such that at an intersection of the fourth impedance transformation unit 41 and the fifth impedance transformation unit 42, a high-frequency signal transmitted via the fourth impedance transformation unit 41 has the same phase as a high-frequency signal transmitted via the fifth impedance transformation unit 42.

It is permissible that the length $L_0$ is set to the minimum possible length as long as the bent portion 46 can achieve a bend angle close to the right angle between the microstrip line 35-2 and the first area 44 both extending in the Y-axis direction and the second area 45 extending from the first area 44 in a diagonal direction. The length $L_0$ is set equal to or smaller than λ/4 and is further set as short as possible relative to λ/4, so that the bent portion 46 becomes closer to the end 38-2. Due to this configuration, on the looped transmission path, a bent part formed between the second impedance transformation unit 34-2 and the microstrip line 35-2 and a bent part formed between the microstrip line 35-2 and the microstrip line 40 are brought closer to each other.

The waveguide microstrip line converter 59, in which the bent parts on the transmission path are brought closer to each other, can reduce the number of locations where unnecessary electromagnetic radiation may occur. Accordingly, the waveguide microstrip line converter 59 can reduce power loss due to unwanted electromagnetic radiation in the line conductor 60 including the looped transmission path.

Because the microstrip line 40 is bent to a relatively small degree at the bent portion 47, the waveguide microstrip line converter 59 can reduce electromagnetic radiation caused by providing the bent portion 47. The microstrip line 40 may not necessarily include the bent portion 47. It is permissible that the second area 45 extends from the bent portion 46 in the X-axis direction and is then connected to the fourth impedance transformation unit 41. It is also permissible that the second area 45 extends from the bent portion 46 in a diagonal direction and is then connected to the fourth impedance transformation unit 41. In the configuration in which the second area 45 extends in a diagonal direction, the fourth impedance transformation unit 41 may extend in the same diagonal direction as the second area 45, and then be connected to the microstrip line 43.

In the waveguide microstrip line converter 59, the fourth and fifth impedance transformation units 41 and 42 are included within the looped transmission path. It is possible for the waveguide microstrip line converter 59 to downsize the configuration in contrast to the case where the impedance transformation units are not included within the looped transmission path.

It is permissible that the microstrip line 43 extends in the direction other than the X-axis direction from the end portion of the fourth impedance transformation unit 41 and from the end portion of the fifth impedance transformation unit 42. The waveguide microstrip line converter 59 can set any direction in which a high-frequency signal is output from the waveguide microstrip line converter 59 and in which a high-frequency signal is input to the waveguide microstrip line converter 59.

The waveguide microstrip line converter 59 can reduce power loss due to unwanted electromagnetic radiation while making it possible to improve the reliability and obtain stable electric performance similarly to the waveguide microstrip line converter 57 according to the second embodiment. Further, the waveguide microstrip line converter 59 sets the length $L_0$ equal to or smaller than λ/4, and thus can reduce power loss due to unwanted electromagnetic radiation on the looped transmission path. Due to this configuration, the waveguide microstrip line converter 59 achieves the effects of obtaining stable and high electric performance while making it possible to improve the reliability.

Figure 15:
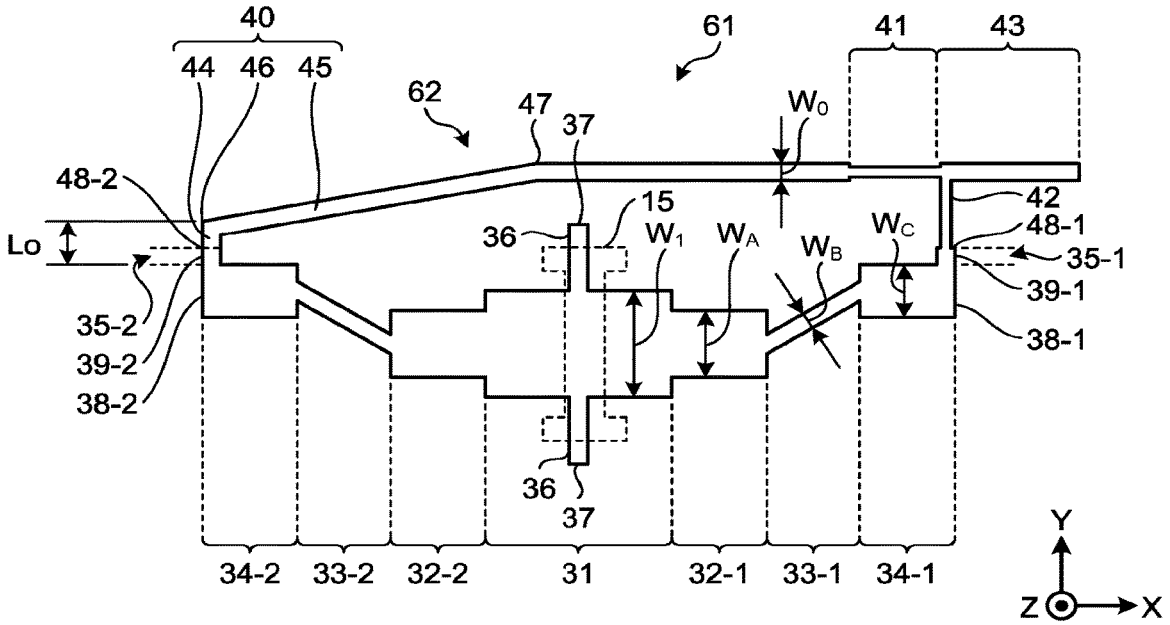
FIG. 15 is a plan view of a line conductor included in a waveguide microstrip line converter according to a first modification of the third embodiment.

FIG. 15 is a plan view of a line conductor 62 included in a waveguide microstrip line converter 61 according to a first modification of the third embodiment. FIG. 15 illustrates the slot 15 by a dotted line for reference purposes. The waveguide microstrip line converter 61 has a similar configuration to the waveguide microstrip line converter 59, except that the relative position of the line conductor 62 to the slot 15 in the X-axis direction is different from that in the waveguide microstrip line converter 59 described above.

In the waveguide microstrip line converter 59 described above, the center position of the stubs 36 in the X-axis direction aligns with the center position of the slot 15 in the X-axis direction. In contrast to this, in the waveguide microstrip line converter 61 illustrated in FIG. 15, the center position of the stubs 36 in the X-axis direction is located on the negative X direction side of the center position of the slot 15 in the X-axis direction.

Similarly to the first embodiment, the waveguide microstrip line converter 61 is provided with the stubs 36 so as to reduce the influence of offset between the line conductor 62 and the slot 15 in the X-axis direction on the phase of a high-frequency signal. In the waveguide microstrip line converter 61, a positional offset between the line conductor 62 and the slot 15 may cause unwanted electromagnetic radiation. It is permissible in the waveguide microstrip line converter 61 that a positional offset between the line conductor 62 and the slot 15 is set in such a manner as to reduce electromagnetic radiation attributable to an asymmetric shape of the line conductor 62. Due to this setting, the waveguide microstrip line converter 61 can reduce power loss due to unwanted electromagnetic radiation.

Figure 16:
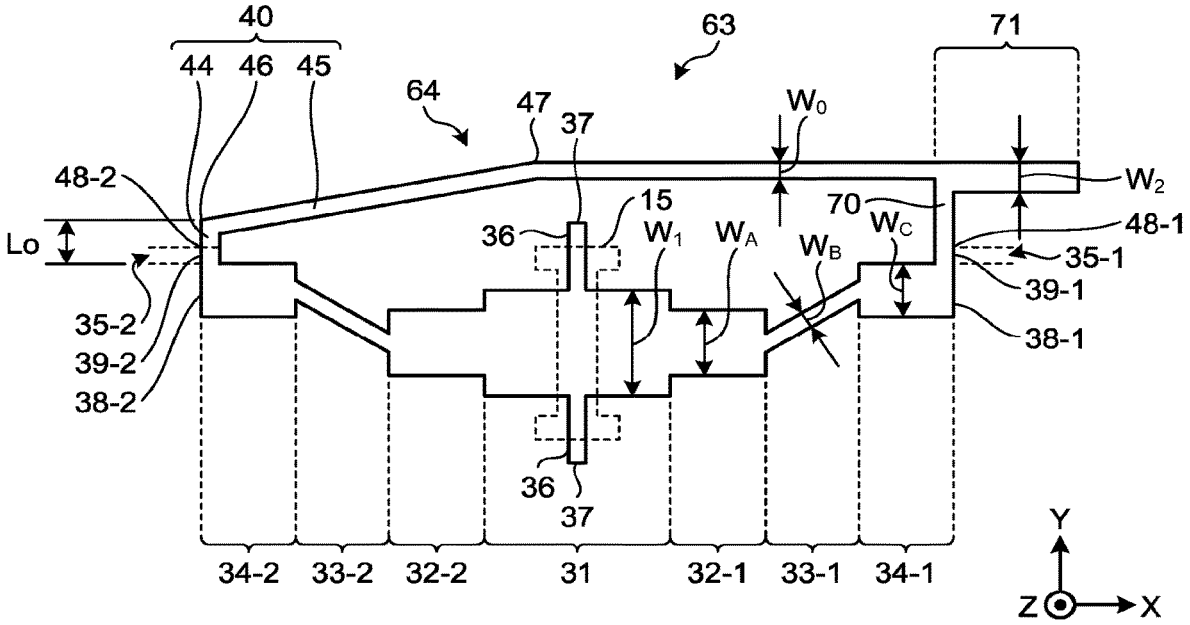
FIG. 16 is a plan view of a line conductor included in a waveguide microstrip line converter according to a second modification of the third embodiment.

FIG. 16 is a plan view of a line conductor 64 included in a waveguide microstrip line converter 63 according to a second modification of the third embodiment. FIG. 16 illustrates the slot 15 by a dotted line for reference purposes. The waveguide microstrip line converter 63 has a similar configuration to the waveguide microstrip line converter 59 described above, except that a microstrip line 70 and a microstrip line 71 that is the fifth section are provided instead of the fourth and fifth impedance transformation units 41 and 42 and the microstrip line 43.

The microstrip line 70 is positioned on the positive Y direction side of the microstrip line 35-1. The microstrip line 70 extends in the Y-axis direction. The line width of the microstrip line 70 represents a width in the X-axis direction. The line length of the microstrip line 70 represents a length in the Y-axis direction.

The microstrip line 71 is positioned on the positive X direction side of the second area 45 of the microstrip line 40. The microstrip line 71 extends in the X-axis direction. An end portion of the microstrip line 71 positioned on the negative X direction side and an end portion of the microstrip line 70 positioned on the positive Y direction side are connected perpendicularly to each other. The line width of the microstrip line 71 represents a width in the Y-axis direction. The line length of the microstrip line 71 represents a length in the X-axis direction. In the waveguide microstrip line converter 63, a transmission path of the microstrip line 35-1 and the microstrip line 70 and a transmission path of the microstrip line 35-2 and the microstrip line 40 are connected to a single transmission path that is the microstrip line 71.

The microstrip line 70 has the line width $W_0$ equal to the line width of the microstrip line 35. The microstrip line 71 has a line width $W_2$ greater than the line width $W_0$ of each of the microstrip line 35 and the microstrip line 70. That is, $W_0$ and $W_2$ satisfy the relation $W_2>W_0$. Each of the microstrip line 70 and the microstrip line 71 is assumed to have any line length.

The phase of a high-frequency signal on the boundary 48-2 between the microstrip line 35-2 and the microstrip line 40 is opposite to the phase of a high-frequency signal on the boundary 48-1 between the microstrip line 35-1 and the microstrip line 70. The waveguide microstrip line converter 63 outputs a high-frequency signal to be transmitted in the positive X direction from the microstrip line 71. It is permissible that the microstrip line 71 extends in the direction other than the X-axis direction from the end portion of the microstrip line 40 and from the end portion of the microstrip line 70. The waveguide microstrip line converter 63 can set any direction in which a high-frequency signal is output from the waveguide microstrip line converter 63 and in which a high-frequency signal is input to the waveguide microstrip line converter 63.

The characteristic impedance of the microstrip line 71 is represented as $Z_2$ corresponding to the line width $W_2$ of the microstrip line 71. As the line width $W_2$ is greater than the line width $W_0$ of each of the microstrip lines 40 and 70, the characteristic impedance $Z_2$ is smaller than the characteristic impedance $Z_0$ of each of the microstrip lines 40 and 70. When characteristic impedance matching is still achieved even though an impedance transformation unit is not provided between the microstrip line 40 and the microstrip line 71 or between the microstrip line 70 and the microstrip line 71, it is permissible that the microstrip lines 40 and 70 are directly connected to the microstrip line 71 similarly to the waveguide microstrip line converter 63. The waveguide microstrip line converter 63 can reduce power loss due to unnecessary electromagnetic radiation by means of characteristic impedance matching between the microstrip lines 40, 70, and 71.

Figure 17:
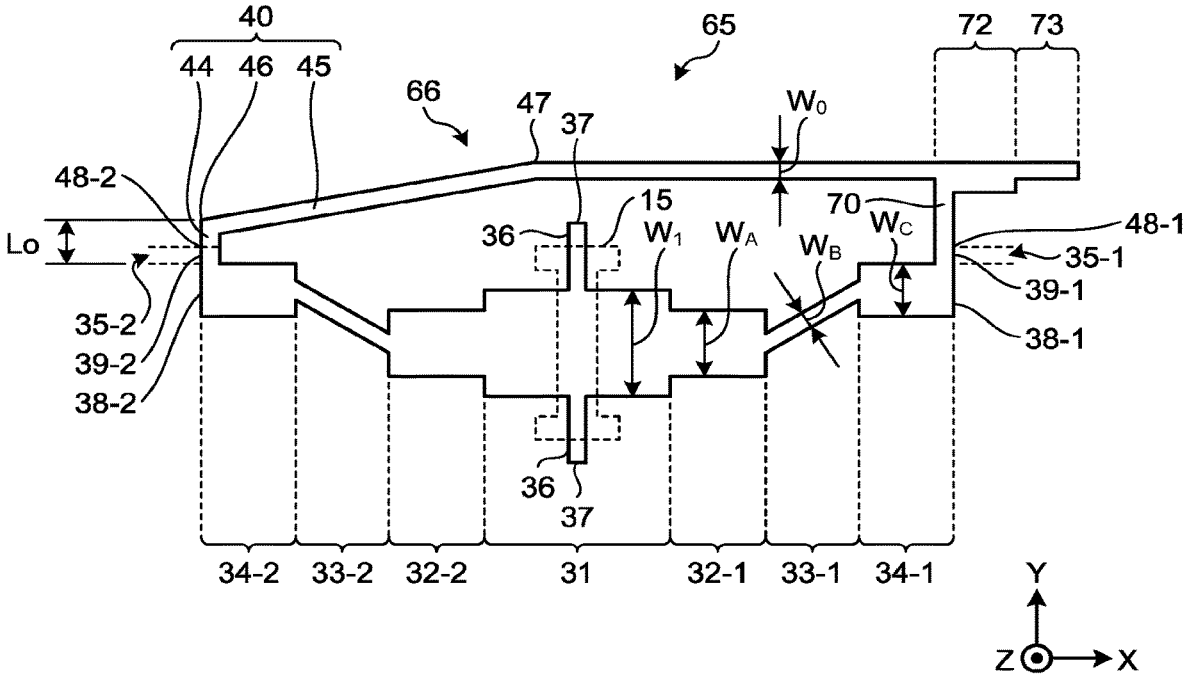
FIG. 17 is a plan view of a line conductor included in a waveguide microstrip line converter according to a third modification of the third embodiment.

FIG. 17 is a plan view of a line conductor 66 included in a waveguide microstrip line converter 65 according to a third modification of the third embodiment. FIG. 17 illustrates the slot 15 by a dotted line for reference purposes. The waveguide microstrip line converter 65 has a similar configuration to the waveguide microstrip line converter 63 according to the above second modification, except that a sixth impedance transformation unit 72 and a microstrip line 73 are provided instead of the microstrip line 71. The sixth impedance transformation unit 72 and the microstrip line 73 are the fifth section to which a transmission path including one microstrip line 35 and a transmission path including another microstrip line 35 are connected. The waveguide microstrip line converter 65 is different from the waveguide microstrip line converter 59 described above in that the sixth impedance transformation unit 72 is provided outside the looped transmission path. In the waveguide microstrip line converter 59, the fourth and fifth impedance transformation units 41 and 42 are provided within the looped transmission path.

The sixth impedance transformation unit 72 is positioned on the positive X direction side of the second area 45 of the microstrip line 40. The sixth impedance transformation unit 72 extends in the X-axis direction. An end portion of the sixth impedance transformation unit 72 positioned on the negative X direction side and an end portion of the microstrip line 70 positioned on the positive Y direction side are connected perpendicularly to each other. The sixth impedance transformation unit 72 performs impedance matching between the microstrip line 73 and the microstrip lines 35-2 and 40 and impedance matching between the microstrip line 70 and the microstrip line 73.

The microstrip line 73 is positioned on the positive X direction side of the sixth impedance transformation unit 72. The microstrip line 73 extends in the X-axis direction. The line width of each of the sixth impedance transformation unit 72 and the microstrip line 73 represents a width in the Y-axis direction. The line length of each of the sixth impedance transformation unit 72 and the microstrip line 73 represents a length in the X-axis direction.

In the waveguide microstrip line converter 65, a transmission path of the microstrip line 35-1 and the microstrip line 70 and a transmission path of the microstrip line 35-2 and the microstrip line 40 are connected to a single transmission path including the sixth impedance transformation unit 72 and the microstrip line 73.

The sixth impedance transformation unit 72 has a line width smaller than a sum $2W_0$ of the line width $W_0$ of the microstrip line 40 and the line width $W_0$ of the microstrip line 70 and greater than the line width of the microstrip line 73. Where the wavelength of a high-frequency signal to be transmitted through the line conductor 66 is represented as $\lambda$, the sixth impedance transformation unit 72 has a line length equivalent to $\lambda/4$. The microstrip line 73 has any line width as long as the line width is smaller than the line width of the sixth impedance transformation unit 72. The microstrip line 73 is assumed to have any line length.

The waveguide microstrip line converter 65 outputs a high-frequency signal to be transmitted in the positive X direction from the microstrip line 73. It is permissible that the sixth impedance transformation unit 72 and the microstrip line 73 extend in the Y-axis direction from the end portion of the microstrip line 40 and from the end portion of the microstrip line 70. The waveguide microstrip line converter 65 can reduce power loss due to unwanted electromagnetic radiation by means of characteristic impedance matching between the microstrip lines 40, 70, and 73 achieved by providing the sixth impedance transformation unit 72.

Fourth Embodiment

Figure 18:
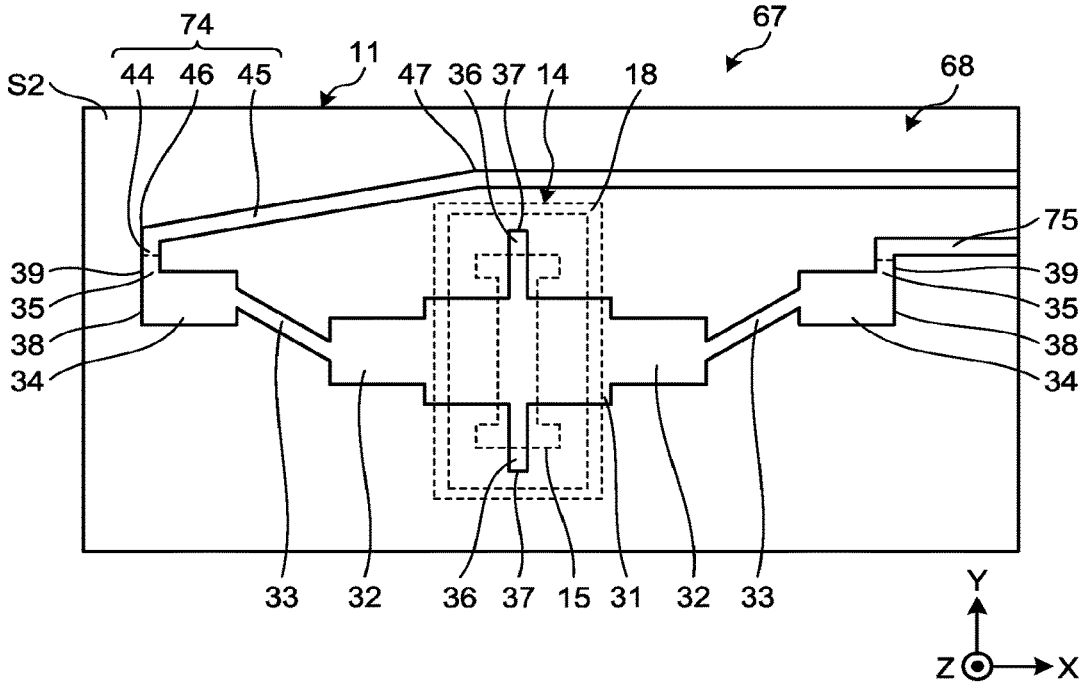
FIG. 18 is a top view illustrating an external configuration of a waveguide microstrip line converter according to a fourth embodiment of the present invention.

FIG. 18 is a top view illustrating an external configuration of a waveguide microstrip line converter 67 according to a fourth embodiment of the present invention. In the waveguide microstrip line converter 67, high-frequency signals to be transmitted in the same direction are output from two transmission paths. The two transmission paths are a transmission path including one microstrip line 35 and a transmission path including another microstrip line 35. High-frequency signals to be transmitted in the same direction are input to these two transmission paths of the waveguide microstrip line converter 67. The waveguide microstrip line converter 67 is different from the waveguide microstrip line converters 61, 63, and 65 according to the above third embodiment in that a looped transmission path is not included. In the fourth embodiment, constituent elements identical to those of the first to third embodiments are denoted by like reference signs, and configurations different from those of the first to third embodiments are mainly described.

In the line conductor 68 of the waveguide microstrip line converter 67, the conversion unit 31, the first, second, and third impedance transformation units 32, 34, and 33, and the microstrip line 35 are configured similarly to those in the line conductor 58 according to the above second embodiment. The line conductor 68 further includes microstrip lines 74 and 75.

Figure 19:
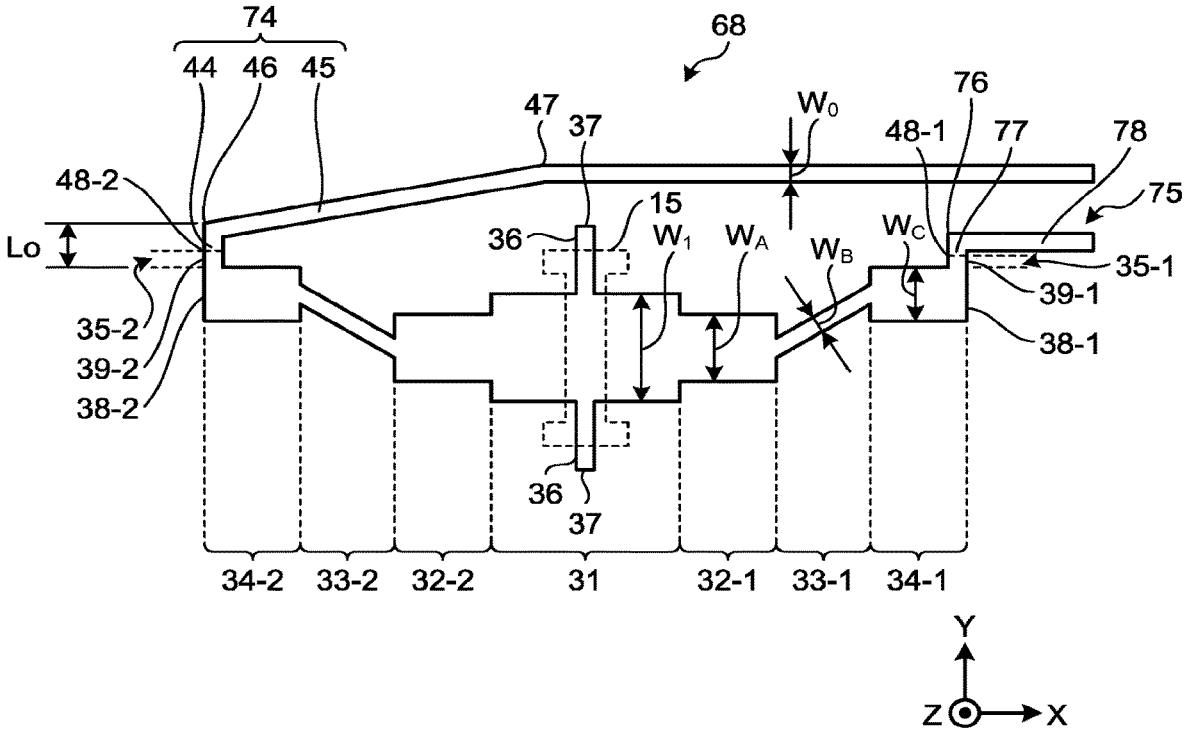
FIG. 19 is a plan view of a line conductor included in the waveguide microstrip line converter illustrated in FIG. 18.

FIG. 19 is a plan view of the line conductor 68 included in the waveguide microstrip line converter 67 illustrated in FIG. 18. FIG. 19 illustrates the slot 15 by a dotted line for reference purposes. The microstrip line 74 is the fourth section provided continuously from the microstrip line 35-2 and is the third microstrip line provided in the line conductor 68. In the fourth embodiment, the microstrip lines 74 and 75 serve as a line through which a high-frequency signal is input from the outside of the waveguide microstrip line converter 67 to the line conductor 68 and a high-frequency signal is output from the line conductor 68 to the outside of the waveguide microstrip line converter 67.

The microstrip line 74 includes the first area 44 extending continuously from the microstrip line 35-2 in the positive Y direction, the second area 45 extending from the first area 44 toward the other side in the X-axis direction, i.e., in the positive X direction, and the bent portion 46 between the first area 44 and the second area 45. The bent portion 47 that forms an obtuse angle is provided in the second area 45. In the manner as described above, the microstrip line 74 has a similar configuration to the microstrip line 40 provided in the line conductors 62, 64, and 66 according to the above third embodiment. Definitions of the line width and the line length of the microstrip line 74 are similar to those of the microstrip line 40. The microstrip line 74 is different from the microstrip line 40 in that the end portion of the microstrip line 74 positioned on the positive X direction side is not connected to any other section of the line conductor 68.

The microstrip line 75 is provided with a bent portion 76 forming a right angle. Between the bent portion 76 and the boundary 48-1 between the microstrip line 75 and the microstrip line 35-1, a section 77 extending slightly in the Y-axis direction is provided. A section 78 of the microstrip line 75, positioned on the positive X direction side of the bent portion 76, extends in the X-axis direction. The line width of the section 77 of the microstrip line 75, extending in the Y-axis direction, represents a width in the X-axis direction. The line length of the section 77 represents a length in the Y-axis direction. The line width of the section 78 of the microstrip line 75, extending in the X-axis direction, represents a width in the Y-axis direction. The line length of the section 78 represents a length in the X-axis direction.

The first area 44 and the second area 45 of the microstrip line 74 have the line width $W_0$ equal to the line width of the microstrip line 35. The sections 77 and 78 of the microstrip line 75 have the line width $W_0$ equal to the line width of the microstrip line 35. Each of the microstrip line 74 and the microstrip line 35 is assumed to have any line length.

Next, an operation of the waveguide microstrip line converter 67 is described with reference to FIG. 19. A case where a high-frequency signal having propagated through the waveguide 14 is transmitted to the microstrip lines 74 and 75 is described as an example. A high-frequency signal propagates from the waveguide 14 to the microstrip lines 35-1 and 35-2 in the same manner as in the second embodiment. The phase of a high-frequency signal on the boundary 48-2 between the microstrip line 35-2 and the microstrip line 74 is opposite to the phase of a high-frequency signal on the boundary 48-1 between the microstrip line 35-1 and the microstrip line 75. A high-frequency signal propagates through the microstrip line 74 in the same manner as the microstrip line 40 according to the third embodiment.

A high-frequency signal having passed through the boundary 48-1 propagates through the microstrip line 75. The microstrip line 74 and the microstrip line 75 output a high-frequency signal to be transmitted in the positive X direction.

It is permissible that the length of the microstrip line 35-1 and the section 77 of the microstrip line 75 is set to the minimum possible length. This makes the bent portion 76 closer to the end 38-1. Due to this configuration, bent parts formed on the transmission path between the second impedance transformation unit 34-1 and the microstrip line 35-1 and between the microstrip line 35-1 and the microstrip line 75 are brought closer to each other.

The waveguide microstrip line converter 67, in which the bent parts on the transmission path are brought closer to each other, can reduce the number of locations where unwanted electromagnetic radiation may occur. Accordingly, the waveguide microstrip line converter 67 can reduce power loss due to unwanted electromagnetic radiation in the line conductor 68 including the microstrip lines 74 and 75 from which a high-frequency signal is output in the same direction. The microstrip line 75 may not necessarily include the section 77 extending in the Y-axis direction. In the waveguide microstrip line converter 67, the microstrip line 35-1 extending in the Y-axis direction is connected to the microstrip line 75 extending in the X-axis direction, so that the bent parts can be brought closer to each other.

The waveguide microstrip line converter 67 can reduce power loss due to unwanted electromagnetic radiation while making it possible to improve the reliability and obtain stable electric performance similarly to the waveguide microstrip line converters 61, 63, and 65 according to the third embodiment. Accordingly, the waveguide microstrip line converter 67 achieves the effects of obtaining stable and high electric performance while making it possible to improve the reliability.

Fifth Embodiment

Figure 20:
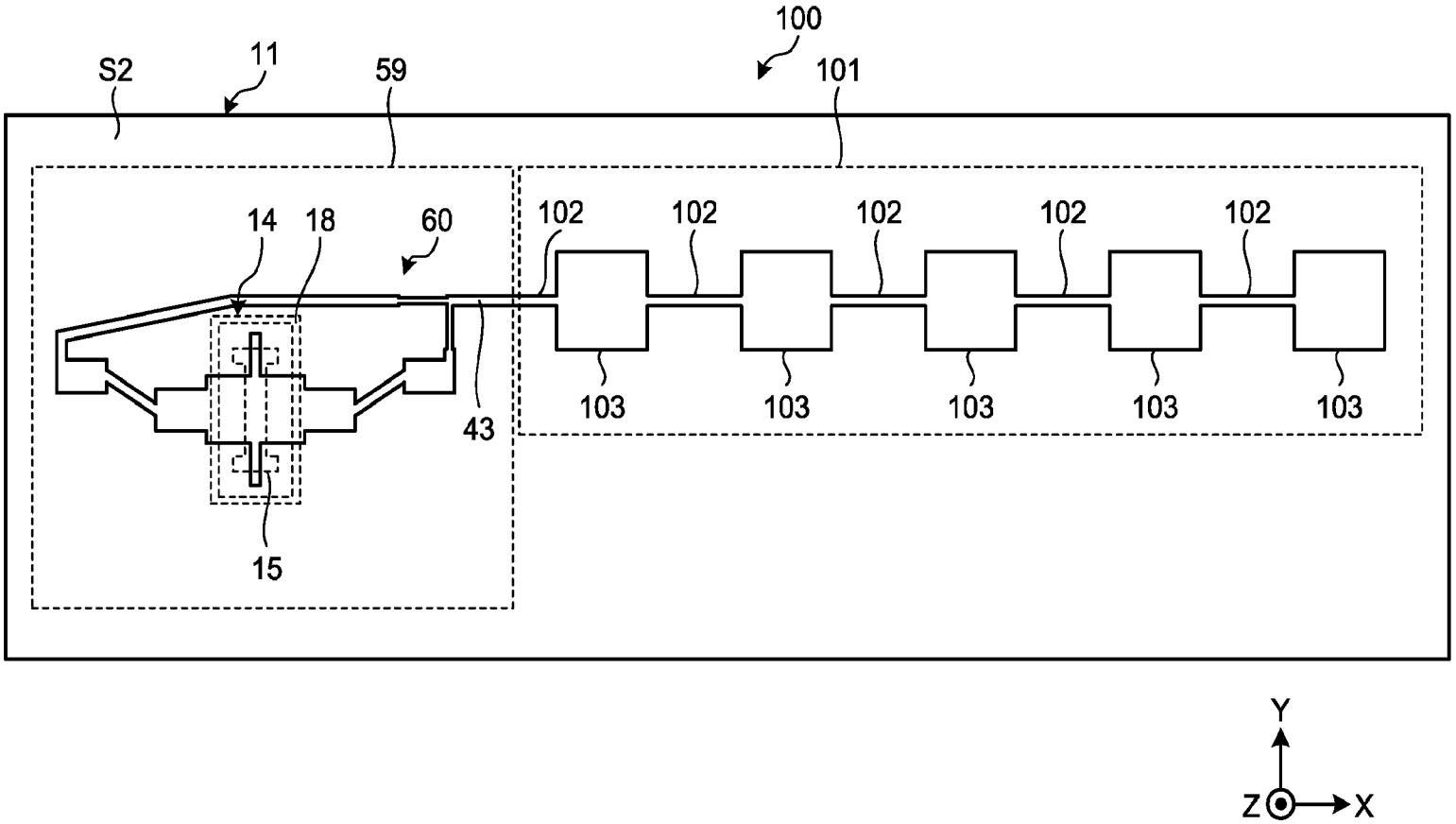
FIG. 20 is a plan view of an antenna device according to a fifth embodiment of the present invention.

FIG. 20 is a plan view of an antenna device 100 according to a fifth embodiment of the present invention. The antenna device 100 is a planar antenna that transmits and receives microwaves or millimeterwaves. The antenna device 100 includes the waveguide microstrip line converter 59 according to the above third embodiment. In the fifth embodiment, constituent elements identical to those of the first to fourth embodiments are denoted by like reference signs, and configurations different from those of the first to fourth embodiments are mainly described.

The antenna device 100 includes the waveguide microstrip line converter 59 and an antenna 101. The antenna 101 includes a plurality of antenna elements 103 connected to the waveguide microstrip line converter 59. The antenna elements 103 are arrayed in the X-axis direction. The antenna elements 103 adjacent to each other in the X-axis direction are connected to each other by a microstrip line 102 extending in the X-axis direction. The end on the negative X direction side of the microstrip line 102 positioned at an end on the negative X direction side in the antenna 101 is connected to an end on the positive X direction side of the microstrip line 43 in the waveguide microstrip line converter 59.

The number of the antenna elements 103 provided in the antenna 101 is not limited to five as illustrated in FIG. 20, but may be any number. It is permissible that the antenna elements 103 provided in the antenna 101 are arrayed in the Y-axis direction instead of being arrayed in the X-axis direction. It is also permissible that the antenna elements 103 provided in the antenna 101 are arrayed in a matrix in the X-axis direction and the Y-axis direction. It is permissible that the antenna 101 is provided with the microstrip line 102 including a branch. It is also permissible that three or more antenna elements 103 are connected to the microstrip line 102 including a branch. The planar shape of the antenna elements 103 is not limited to a rectangular shape, but may be a shape other than the rectangular shape.

The line conductor 60 and the antenna 101 are formed on the second surface S2 of the dielectric substrate 11. The line conductor 60 and the antenna 101 are formed from a single piece of metal member, and are formed by patterning a copper foil press-bonded onto the second surface S2. In the same manner as illustrated in FIG. 2, the ground conductor 12 is provided on the entirety of the first surface S1 of the dielectric substrate 11 on the negative Z direction side.

The line conductor 60 and the antenna 101 are located on the common second surface S2, and can thus be formed by a common process. In one example, the line conductor 60 and the antenna 101 can be formed by a common film forming process and a common patterning process. The antenna device 100 does not require a process of forming the antenna 101 separate from the process of forming the line conductor 60. This makes it possible to simplify the manufacturing processes and reduce the manufacturing costs. It is permissible that the line conductor 60 and the antenna 101 are a metal plate that has been formed in advance and then attached to the dielectric substrate 11.

In the fifth embodiment, a through hole in the dielectric substrate 11 between the antenna 101 and the ground conductor 12 is not necessary. Moreover, similarly to the above third embodiment, the waveguide microstrip line converter 59 does not require a through hole in the dielectric substrate 11. Because the antenna device 100 can omit machining to form a through hole, it is possible to simplify the manufacturing processes and reduce the manufacturing costs. The antenna device 100 obtains stable transmission power and reception power, and can thus obtain stable communication performance.

According to the fifth embodiment, the antenna device 100 is provided with the waveguide microstrip line converter 59, and can accordingly obtain stable and high electric performance while making it possible to improve the reliability. The antenna device 100 is provided with the line conductor 60 and the antenna 101 on the second surface S2. This makes it possible to simplify the manufacturing processes and reduce the manufacturing costs.

Figure 21:
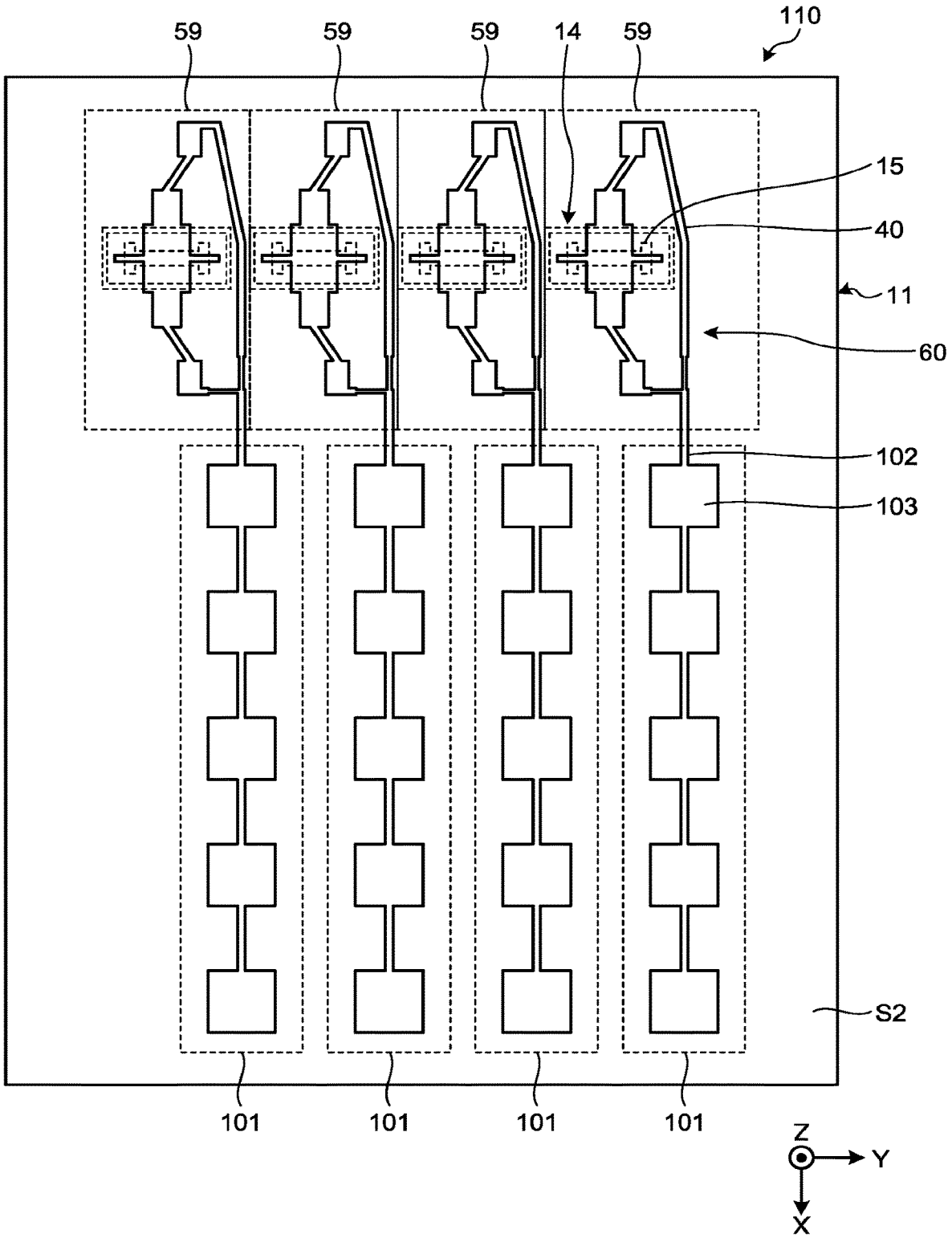
FIG. 21 is a plan view of an antenna device according to a modification of the fifth embodiment.

FIG. 21 is a plan view of an antenna device 110 according to a modification of the fifth embodiment. The antenna device 110 is a planar antenna that transmits and receives microwaves or millimeterwaves. The antenna device 110 includes a plurality of waveguide microstrip line converters 59, and antennas 101 provided respectively for the waveguide microstrip line converters 59.

The waveguide microstrip line converter 59 and the antenna 101 are arrayed in the X-axis direction and connected with each other. Plural combinations of the waveguide microstrip line converter 59 and the antenna 101 are arrayed in the Y-axis direction. The number of the combinations of the waveguide microstrip line converter 59 and the antenna 101 provided in the antenna device 110 is not limited to four as illustrated in FIG. 21, but may be any number.

The antenna device 110 is provided with the waveguide microstrip line converters 59, and is thus capable of controlling the phase of a high-frequency signal transmitted through the waveguide 14 in each of the waveguide microstrip line converters 59. When the antenna device 110 transmits electromagnetic waves, the antenna device 110 controls the phase of a high-frequency signal so that it is possible to perform beam scanning in the Y-axis direction.

In each of the waveguide microstrip line converters 59, constituent elements including a pair of stubs 36 are accommodated within the area of the waveguide 14 in the Y-axis direction. It is sufficient if the waveguide microstrip line converter 59 has a size in the Y-axis direction large enough to accommodate the waveguide 14 and one microstrip line 40. This can reduce the size of each waveguide microstrip line converter 59 in the Y-axis direction. As each waveguide microstrip line converter 59 has a reduced size in the Y-axis direction, the layout of the waveguide microstrip line converters 59 in the antenna device 110 can be less restricted. In the antenna device 110, the waveguide microstrip line converters 59 can be located more closely to each other.

The antenna device 110 according to the present modification is also provided with the waveguide microstrip line converters 59, and can accordingly obtain stable and high electric performance while making it possible to improve the reliability. The antenna device 110 is provided with the line conductor 60 and the antenna 101 on the second surface S2. This makes it possible to simplify the manufacturing processes and reduce the manufacturing costs.

It is permissible that each of the antenna devices 100 and 110 according to the fifth embodiment includes any of the waveguide microstrip line converters according to the respective embodiments described above instead of the waveguide microstrip line converter 59. It is permissible that the configuration of the antenna device 100 or 110 is included in a radar device. The radar device can obtain stable transmission power and reception power, and can thus obtain stable detection performance.

Sixth Embodiment

Figure 22:
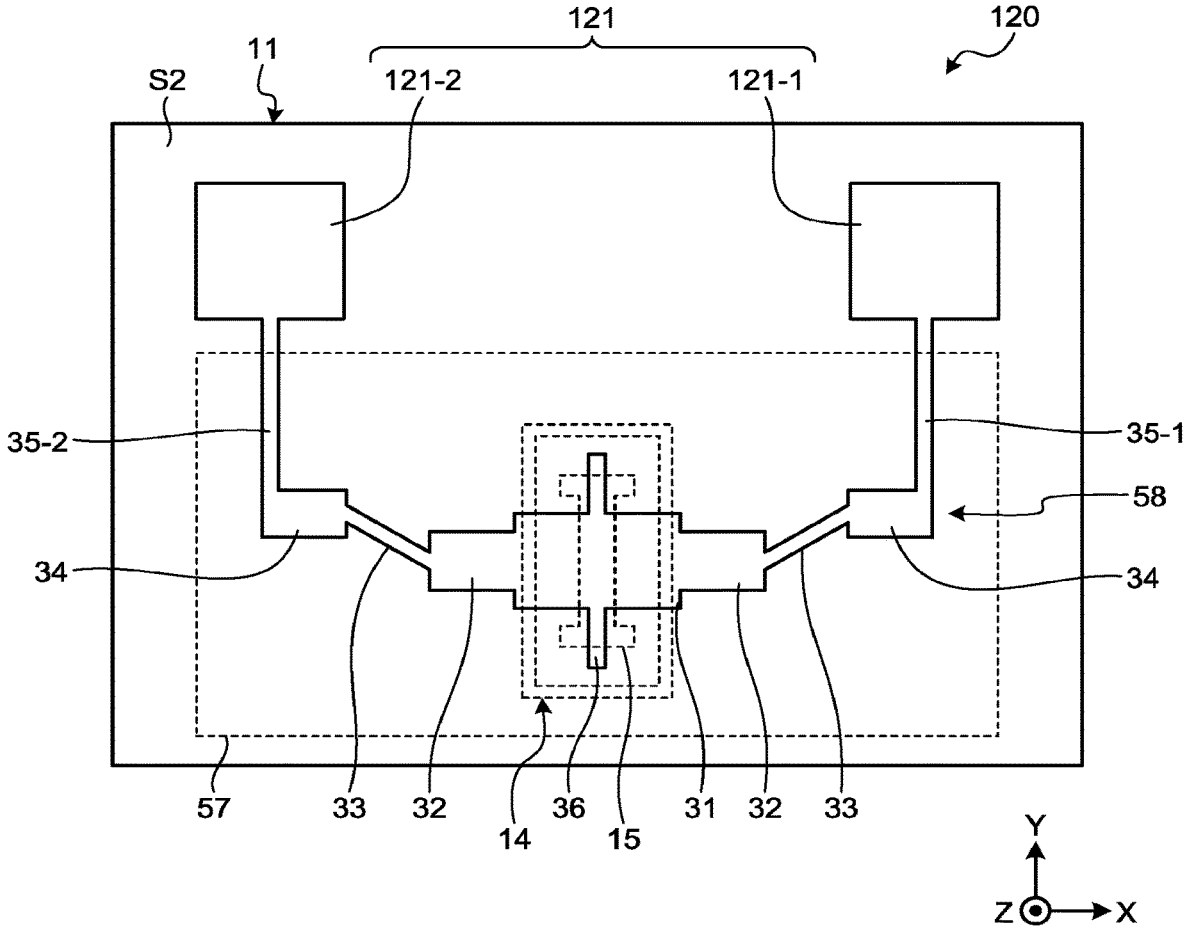
FIG. 22 is a plan view of an antenna device according to a sixth embodiment of the present invention.

FIG. 22 is a plan view of an antenna device 120 according to a sixth embodiment of the present invention. The antenna device 120 includes the waveguide microstrip line converter 57 according to the above second embodiment. In the sixth embodiment, constituent elements identical to those of the first to fifth embodiments are denoted by like reference signs, and configurations different from those of the first to fifth embodiments are mainly described.

The antenna device 120 is a planar antenna that transmits and receives microwaves or millimeterwaves. The antenna device 120 includes two antenna elements 121-1 and 121-2 constituting the antenna. The antenna elements 121-1 and 121-2, when they are not distinguished from each other, are collectively referred to as "antenna element 121". The line conductor 58 and the antenna element 121 are provided on the second surface S2 of the dielectric substrate 11. The microstrip lines 35-1 and 35-2 have a linear shape extending in the Y-axis direction from the second impedance transformation unit 34.

The antenna element 121-1 is connected to one of the opposite ends of the microstrip line 35-1 in the Y-axis direction, the one end being positioned on the positive Y direction side and being opposite to the end connected to the second impedance transformation unit 34. The antenna element 121-2 is connected to one of the opposite ends of the microstrip line 35-2 in the Y-axis direction, the one end being positioned on the positive Y direction side and being opposite to the end connected to the second impedance transformation unit 34. In the manner as described above, the end of each of the microstrip lines 35-1 and 35-2 positioned on the positive Y direction side serves as a terminal of the waveguide microstrip line converter 57 that is connectable to the antenna element 121.

The line conductor 58 and the antenna element 121 are located on the common second surface S2, and can thus be formed by a common process. In one example, the line conductor 58 and the antenna element 121 can be formed by a common film forming process and a common patterning process. The antenna device 120 does not require a process of forming the antenna element 121 separate from the process of forming the line conductor 58. This makes it possible to simplify the manufacturing processes and reduce the manufacturing costs. It is permissible that the line conductor 58 and the antenna element 121 are a metal plate that has been formed in advance and then attached to the dielectric substrate 11. The planar shape of the antenna element 121 is not limited to a rectangular shape, but may be a shape other than the rectangular shape.

Assuming that the position on the second surface S2 is represented by two-dimensional coordinates defined on the basis of the X-axis and the Y-axis, the position on the second surface S2 in the Y-axis direction is defined as the Y coordinate and the position in the second surface S2 in the X-axis direction is defined as the X coordinate. The X coordinate at the center of the antenna element 121-1 in the X-axis direction corresponds with the X coordinate at the center of the microstrip line 35-1 in the X-axis direction. The X coordinate at the center of the antenna element 121-2 in the X-axis direction corresponds with the X coordinate at the center of the microstrip line 35-2 in the X-axis direction.

Next, the influence of unwanted electromagnetic radiation on the radiation pattern of the antenna device 120 is described. In general, power loss in the waveguide microstrip line converter 57, attributable to the dielectric loss tangent of the dielectric substrate 11 or the conductivity of the line conductor 58, increases as the line length increases. At a location such as a bend location or a branch location on the transmission path, unwanted electromagnetic radiation may occur. As the line length of the line conductor 58 increases or electromagnetic radiation increases on the transmission path, electromagnetic waves to be radiated from the antenna element 121 decrease in the antenna device 120.

The source of electromagnetic radiation from the antenna element 121 and the source of electromagnetic radiation on the transmission path are present at different positions from each other on the second surface S2 that is one X-Y plane parallel to the X-axis direction and the Y-axis direction. For this reason, unwanted electromagnetic waves from the transmission path are superimposed on the radiation pattern of the antenna element 121. The phase difference between electromagnetic waves radiated from the antenna element 121 and unwanted electromagnetic waves from the transmission path varies with each angle of direction on the X-Y plane. This may cause ripples that are periodic fluctuations in the radiation pattern of the antenna element 121.

Figure 23:
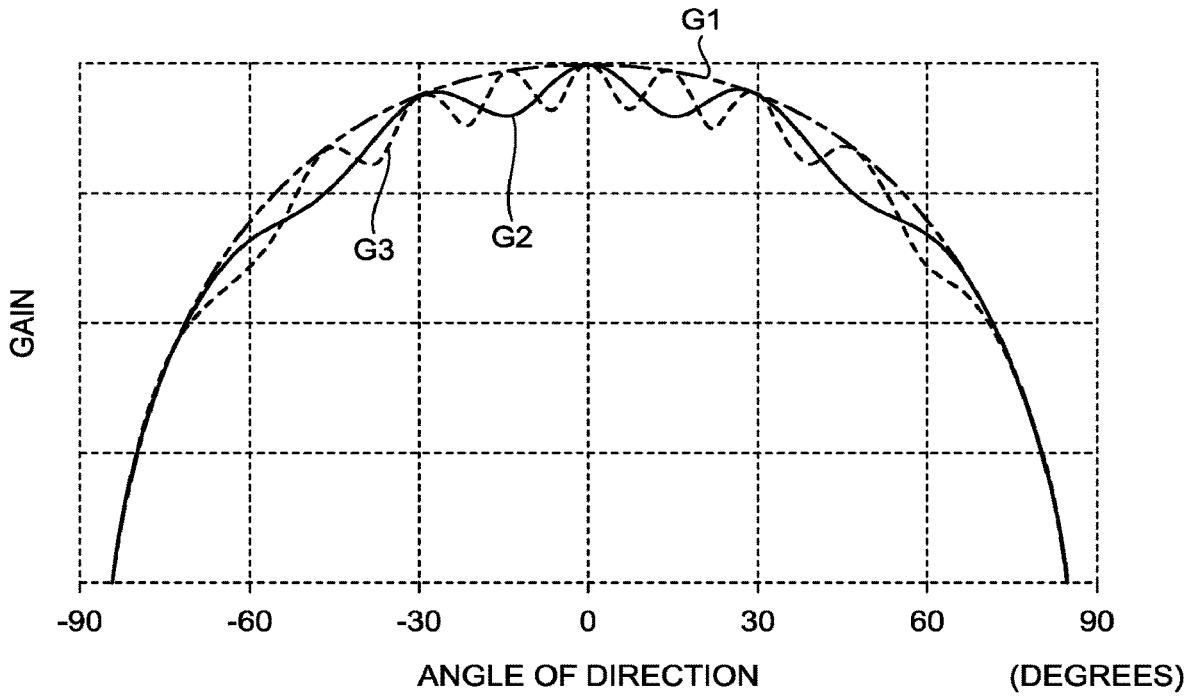
FIG. 23 is a diagram illustrating an example of a radiation pattern of an antenna element included in the antenna device illustrated in FIG. 22.

FIG. 23 is a diagram illustrating an example of a radiation pattern of the antenna element 121 included in the antenna device 120 illustrated in FIG. 22. The graph illustrated in FIG. 23 shows a relation between the angle of direction on the X-Y plane and the gain. The gain is represented by any measurement unit. The direction in which the gain becomes maximum is defined as the reference angle of direction which is zero degrees. FIG. 23 illustrates a change in the gain at each angle of direction in three cases including a case where no ripples occur and two cases where ripples have occurred. A graph G1 illustrates the case where no ripples occur. A graph G2 illustrates one of the two cases where ripples have occurred, in which longer-period ripples have occurred. A graph G3 illustrates the other case where shorter-period ripples have occurred.

In designing the antenna device 120, the Y coordinate of the waveguide microstrip line converter 57 and the Y coordinate of the antenna element 121 are assumed to have been determined in advance according to the design limitations. Adjustment of the line length of each portion of the line conductor 58 and adjustment of the inclination of the third impedance transformation unit 33 relative to the X-axis allow more flexibility in designing the waveguide microstrip line converter 57. In the antenna device 120, the configuration of the waveguide microstrip line converter 57 is adjusted such that the antenna element 121 can be directly connected to the microstrip line 35 with a linear shape. Due to the adjustment in designing the waveguide microstrip line converter 57, the antenna device 120 can also reduce unwanted electromagnetic radiation.

In the antenna device 120, the antenna element 121 is directly connected to the microstrip line 35 with a linear shape, so that the waveguide microstrip line converter 57 and the antenna element 121 are connected by a wire of the shortest possible length. The antenna device 120 can reduce the length of the wire used for connecting the waveguide microstrip line converter 57 and the antenna element 121, and thus can reduce power loss attributable to the line length of this wire. In the antenna device 120, other than the bent part on the transmission path of the waveguide microstrip line converter 57, there is no additional bent part resulting from the connection of the antenna element 121 to the waveguide microstrip line converter 57. The antenna device 120 can limit unwanted electromagnetic radiation attributable to bending of the transmission path to only the radiation in the waveguide microstrip line converter 57, and can thus reduce an increase in unwanted electromagnetic radiation. Accordingly, the antenna device 120 is capable of reducing unwanted electromagnetic waves to be superimposed on the radiation pattern of the antenna element 121, and consequently can reduce ripples. Because of a reduction in ripples and a reduction in power loss, the antenna device 120 can obtain stable and high electric performance.

A transmission path of the antenna device 120 is symmetric in the X-axis direction. The transmission path symmetric in the X-axis direction indicates that the transmission path is symmetric with respect to a line extending to pass the center of the line conductor 58 in the X-axis direction and parallel to the Y-axis, that is, the transmission path is symmetric in the lateral direction in FIG. 22. The antenna device 120 has a configuration in which the transmission path is symmetric in the X-axis direction, and thus can reduce imbalance in electromagnetic radiation in which electromagnetic radiation becomes intense in a specific direction than any other directions, and obtain high electric performance accordingly.

According to the sixth embodiment, the antenna device 120 includes the waveguide microstrip line converter 57, and the antenna element 121 is connected to the microstrip line 35 having a linear shape. Thus, the antenna device 120 can obtain stable and high electric performance while making it possible to improve the reliability.

Figure 24:
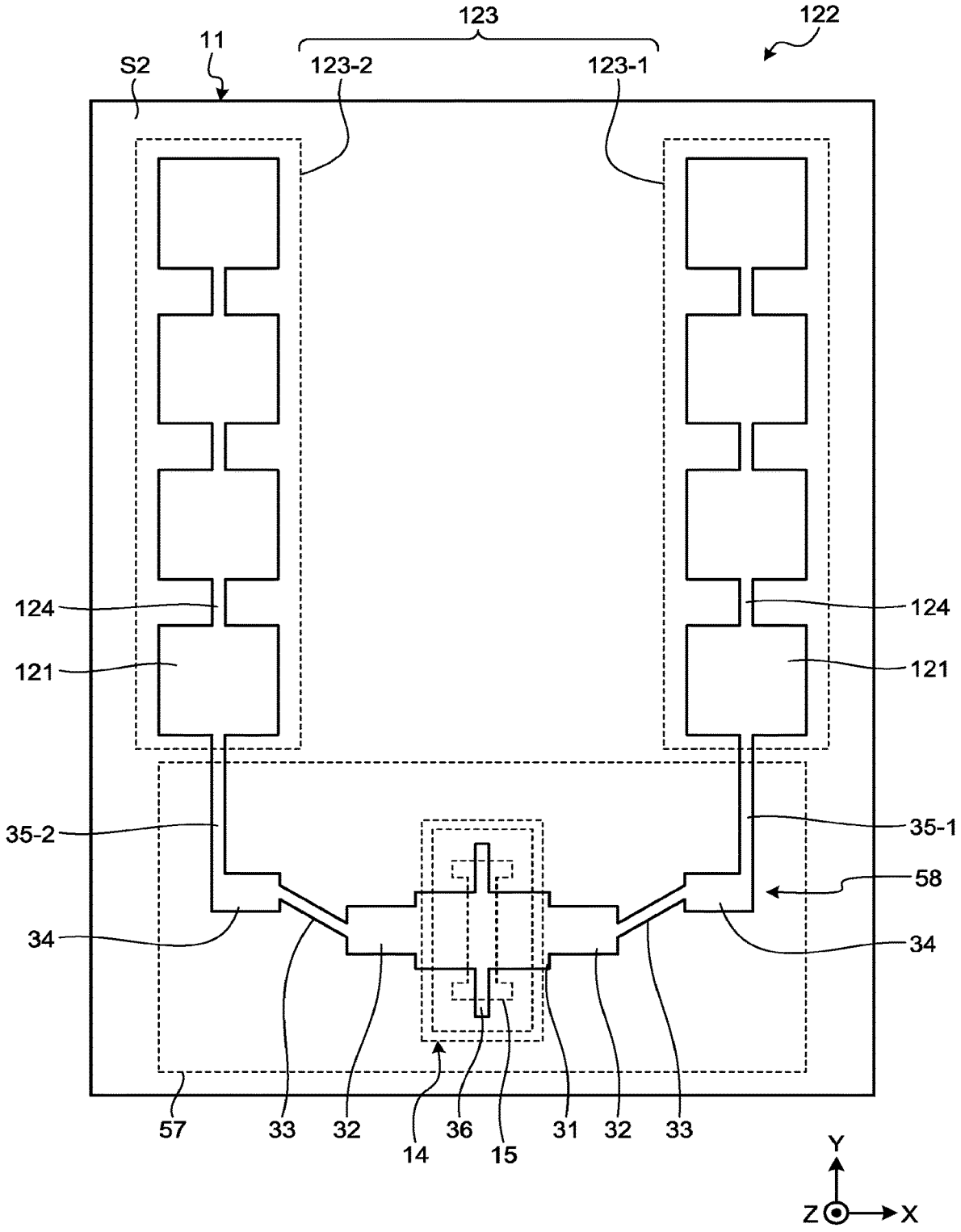
FIG. 24 is a plan view of an antenna device according to a first modification of the sixth embodiment.

It is permissible that a plurality of antenna elements 121 are connected to the microstrip line 35. FIG. 24 is a plan view of an antenna device 122 according to a first modification of the sixth embodiment. The antenna device 122 includes two array antennas 123-1 and 123-2. Each of the array antennas 123-1 and 123-2 is an antenna including a plurality of antenna elements 121 arrayed in the Y-axis direction. The array antennas 123-1 and 123-2, when they are not distinguished from each other, are collectively referred to as "array antenna 123".

In FIG. 24, four antenna elements 121 are provided in the array antenna 123. The antenna elements 121 adjacent to each other in the Y-axis direction are connected with each other by a microstrip line 124 having a linear shape extending in the Y-axis direction. The antenna element 121, positioned at the end on the negative Y direction side in the array antenna 123-1, is connected to the microstrip line 35-1 in the same manner as the antenna element 121-1 illustrated in FIG. 22. The antenna element 121, positioned at the end on the negative Y direction side in the array antenna 123-2, is connected to the microstrip line 35-2 in the same manner as the antenna element 121-2 illustrated in FIG. 22.

The number of the antenna elements 121 provided in the array antenna 123 is not limited to four, but may be any number. It is also permissible that the antenna elements 121 provided in the array antenna 123 are arrayed in a matrix in the X-axis direction and the Y-axis direction. It is permissible that the antenna elements 121 arrayed in a matrix are connected to a microstrip line with a branch. The antenna elements 121 may be connected to a microstrip line branched into plural sections extending in any direction on the X-Y plane.

Figure 25:
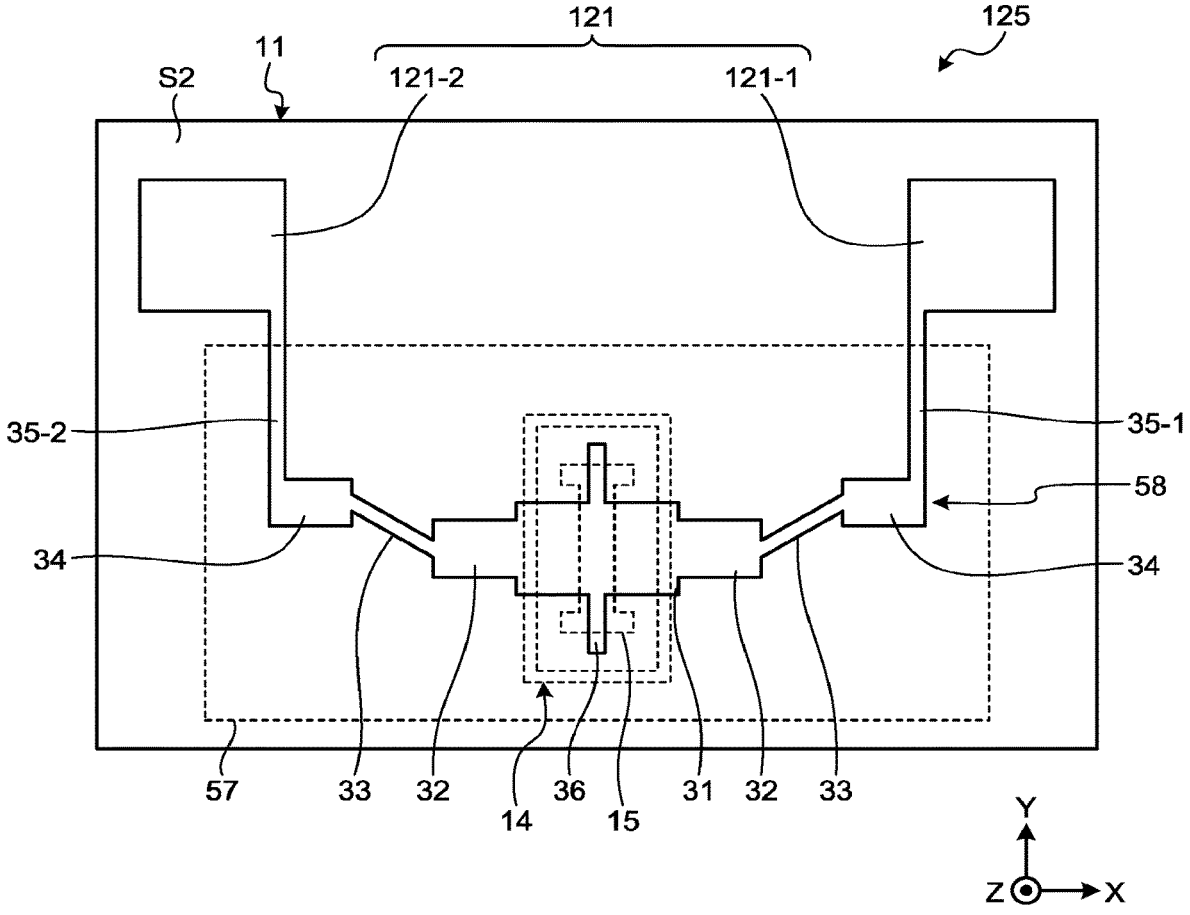
FIG. 25 is a plan view of an antenna device according to a second modification of the sixth embodiment.

It is permissible that the microstrip line 35 is connected to a portion of the antenna element 121 at a position other than the center in the X-axis direction. FIG. 25 is a plan view of an antenna device 125 according to a second modification of the sixth embodiment. The antenna device 125 includes two antenna elements 121-1 and 121-2 constituting the antenna. The microstrip line 35-1 is connected to an end portion of the antenna element 121-1 positioned on the negative X direction side. The microstrip line 35-2 is connected to an end portion of the antenna element 121-2 positioned on the positive X direction side. The microstrip line 35 is connected to a portion of the antenna element 121 at any position in the X-axis direction.

Figure 26:
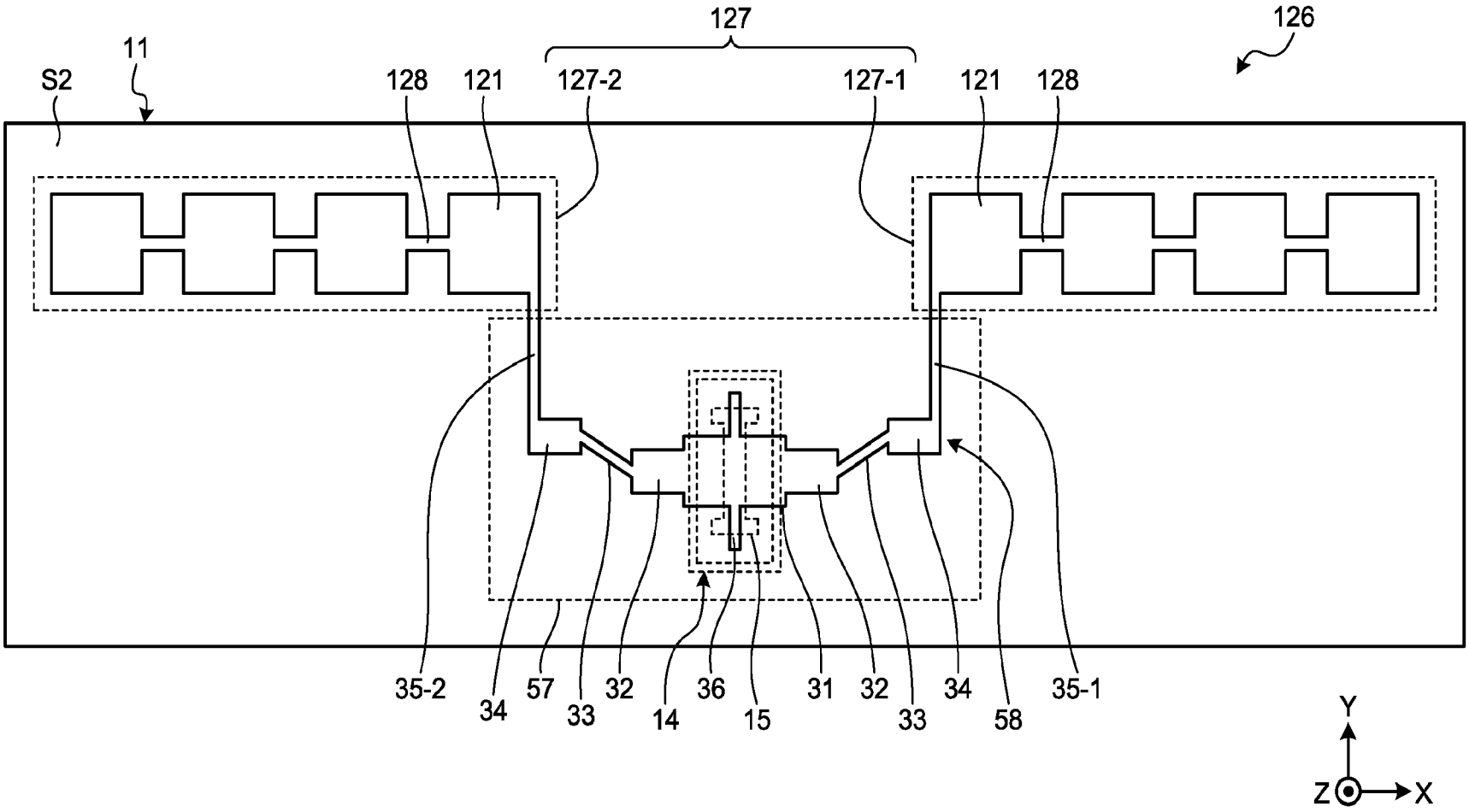
FIG. 26 is a plan view of an antenna device according to a third modification of the sixth embodiment.

It is permissible that a plurality of antenna elements 121 arrayed in the X-axis direction are connected to the microstrip line 35. FIG. 26 is a plan view of an antenna device 126 according to a third modification of the sixth embodiment. The antenna device 126 includes two array antennas 127-1 and 127-2. Each of the array antennas 127-1 and 127-2 is an antenna including a plurality of antenna elements 121 arrayed in the X-axis direction. The array antennas 127-1 and 127-2, when they are not distinguished from each other, are collectively referred to as "array antenna 127".

In FIG. 26, four antenna elements 121 are provided in the array antenna 127. The antenna elements 121 adjacent to each other in the X-axis direction are connected with each other by a microstrip line 128 having a linear shape extending in the X-axis direction. The antenna element 121, positioned at the end on the negative X direction side in the array antenna 127-1, is connected to the microstrip line 35-1 in the same manner as the antenna element 121-1 illustrated in FIG. 25. The antenna element 121, positioned at the end on the positive X direction side in the array antenna 127-2, is connected to the microstrip line 35-2 in the same manner as the antenna element 121-2 illustrated in FIG. 25.

The number of the antenna elements 121 provided in the array antenna 127 is not limited to four, but may be any number. It is also permissible that the antenna elements 121 provided in the array antenna 127 are arrayed in a matrix in the X-axis direction and the Y-axis direction. It is permissible that the antenna elements 121 arrayed in a matrix are connected to a microstrip line with a branch. The antenna elements 121 may be connected to a microstrip line branched into plural sections extending in any direction on the X-Y plane.

The antenna devices 122, 125, and 126 according to the respective modifications of the sixth embodiment can also obtain stable and high electric performance because of a reduction in ripples and a reduction in power loss similarly to the antenna device 120 illustrated in FIG. 22.

It is permissible that each of the antenna devices 120, 122, 125, and 126 according to the sixth embodiment includes any of the waveguide microstrip line converters 10, 51, 53, and 55 according to the above first embodiment instead of the waveguide microstrip line converter 57. The waveguide microstrip line converters 10, 51, 53, and 55 have a common configuration with the waveguide microstrip line converter 57 in that the antenna element 121 is connectable to an end of each of the two microstrip lines 35 extending in the Y-axis direction. In a case where each of the antenna devices 120, 122, 125, and 126 includes any of the waveguide microstrip line converters 10, 51, 53, and 55, the antenna devices 120, 122, 125, and 126 can also obtain stable and high electric performance because of a reduction in ripples and a reduction in power loss, similarly to the case where each of the antenna devices 120, 122, 125, and 126 includes the waveguide microstrip line converter 57.

Seventh Embodiment

Figure 27:
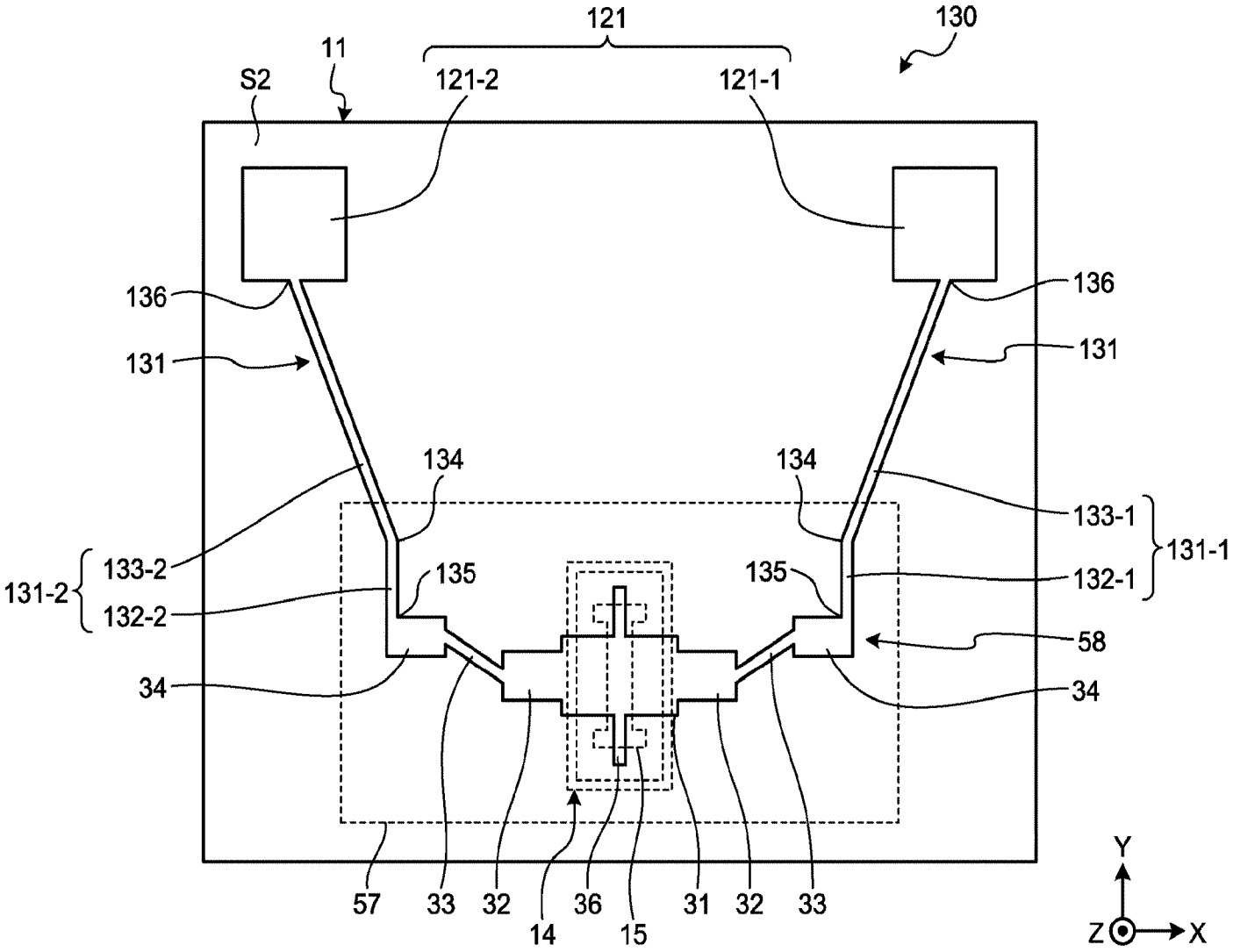
FIG. 27 is a plan view of an antenna device according to a seventh embodiment of the present invention.

FIG. 27 is a plan view of an antenna device 130 according to a seventh embodiment of the present invention. The antenna device 130 includes microstrip lines 131-1 and 131-2 instead of the microstrip lines 35-1 and 35-2 according to the sixth embodiment. Each of the microstrip lines 131-1 and 131-2 includes a bent portion 134. In the seventh embodiment, constituent elements identical to those of the first to sixth embodiments are denoted by like reference signs, and configurations different from those of the first to sixth embodiments are mainly described.

The antenna device 130 is a planar antenna that transmits and receives microwaves or millimeterwaves. The antenna device 130 includes two antenna elements 121-1 and 121-2 constituting the antenna. The microstrip lines 131-1 and 131-2, when they are not distinguished from each other, are collectively referred to as "microstrip line 131".

The microstrip line 131-1 is bent at the bent portion 134 between a part 132-1 and a part 133-1. The part 132-1 extends from the second impedance transformation unit 34 in the positive Y direction. The part 133-1 extends from the part 132-1 in a diagonal direction between the positive Y direction and the positive X direction. On the microstrip line 131-1, the bent portion 134 is the boundary between the part 132-1 and the part 133-1. The bent portion 134 forms an obtuse bend angle. An end 136 of the part 133-1 positioned on the positive Y direction side is connected to the antenna element 121-1. An end 135 of the part 132-1 positioned on the negative Y direction side is connected to the second impedance transformation unit 34.

The microstrip line 131-2 is bent at the bent portion 134 between a part 132-2 and a part 133-2. The part 132-2 extends from the second impedance transformation unit 34 in the positive Y direction. The part 133-2 extends from the part 132-2 in a diagonal direction between the positive Y direction and the negative X direction. On the microstrip line 131-2, the bent portion 134 is the boundary between the part 132-2 and the part 133-2. The bent portion 134 forms an obtuse bend angle. An end 136 of the part 133-2 positioned on the positive Y direction side is connected to the antenna element 121-2. An end 135 of the part 132-2 positioned on the negative Y direction side is connected to the second impedance transformation unit 34.

The microstrip line 131 includes the bent portion 134 forming an obtuse bend angle. Thus, as compared to the case where the bend angle of the bent portion 134 is a right angle or an acute bend angle, the microstrip line 131 is capable of moderating the change in the direction of the transmission path at the bent portion 134. The antenna device 130 can moderate the change in the direction of the transmission path intended to connect to the antenna element 121, and can thus reduce unwanted electromagnetic radiation.

In designing the antenna device 130, the X coordinate and the Y coordinate of the waveguide microstrip line converter 57 and the X coordinate and the Y coordinate of the antenna element 121 are assumed to have been determined in advance according to the design limitations. The length and the bend angle of each portion of the microstrip line 131 are adjusted such that the waveguide microstrip line converter 57 and the antenna element 121 can be connected. In adjusting the length and the bend angle, the microstrip line 131-1 and the microstrip line 131-2 are made symmetric in the X-axis direction. As the bent portion 134 is positioned closer to the end of the microstrip line 131 positioned on the negative Y direction side, the bend angle becomes closer to 180 degrees. As the bend angle becomes closer to 180 degrees, there is a smaller change in the direction of the transmission path, so that the antenna device 130 can reduce electromagnetic radiation at the bent portion 134.

The antenna device 130 is capable of reducing unwanted electromagnetic waves to be superimposed on the radiation pattern of the antenna element 121, and consequently can reduce ripples. Because of a reduction in ripples and a reduction in power loss, the antenna device 130 can obtain stable and high electric performance.

Because the microstrip line 131-1 and the microstrip line 131-2 are symmetric in the X-axis direction, the transmission path of the antenna device 130 is symmetric in its entirety in the X-axis direction. The antenna device 130 has a symmetric configuration of the transmission path in the X-axis direction, and thus can reduce imbalance in electromagnetic radiation and obtain high electric performance accordingly.

According to the seventh embodiment, the antenna device 130 includes the waveguide microstrip line converter 57, and the antenna element 121 is connected to the microstrip line 131 including the bent portion 134 forming an obtuse bend angle. Thus, the antenna device 130 can obtain stable and high electric performance while making it possible to improve the reliability.

It is permissible that the antenna device 130 according to the seventh embodiment includes any of the waveguide microstrip line converters 10, 51, 53, and 55 according to the above first embodiment instead of the waveguide microstrip line converter 57. In a case where the antenna device 130 includes any of the waveguide microstrip line converters 10, 51, 53, and 55, the antenna device 130 can also obtain stable and high electric performance because of a reduction in ripples and a reduction in power loss, similarly to the case where the antenna device 130 includes the waveguide microstrip line converter 57.

Eighth Embodiment

Figure 28:
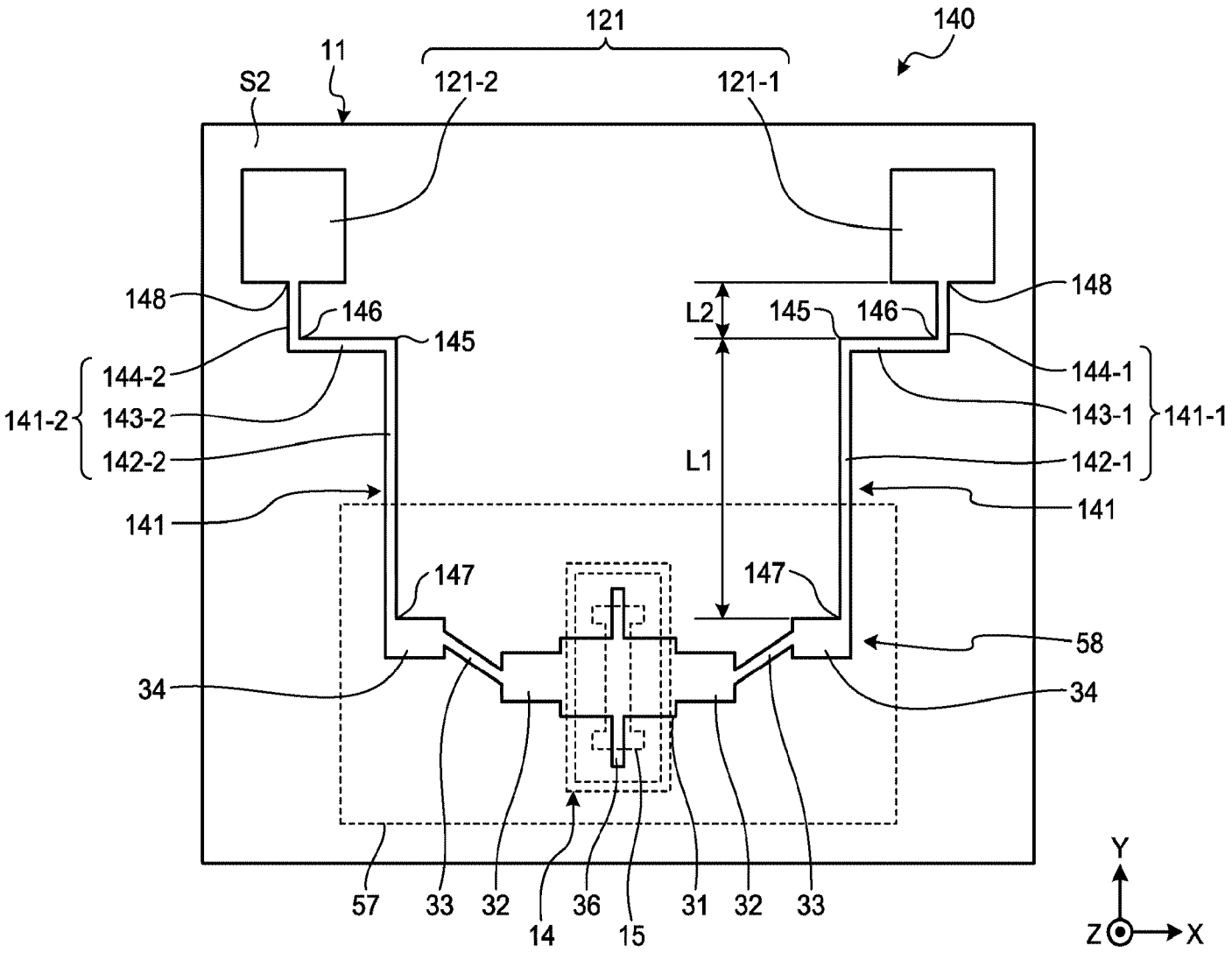
FIG. 28 is a plan view of an antenna device according to an eighth embodiment of the present invention.

FIG. 28 is a plan view of an antenna device 140 according to an eighth embodiment of the present invention. The antenna device 140 includes microstrip lines 141-1 and 141-2 instead of the microstrip lines 35-1 and 35-2 according to the sixth embodiment. Each of the microstrip lines 141-1 and 141-2 includes bent portions 145 and 146. In the eighth embodiment, constituent elements identical to those of the first to seventh embodiments are denoted by like reference signs, and configurations different from those of the first to seventh embodiments are mainly described.

The antenna device 140 is a planar antenna that transmits and receives microwaves or millimeterwaves. The antenna device 140 includes two antenna elements 121-1 and 121-2 constituting the antenna. The microstrip lines 141-1 and 141-2, when they are not distinguished from each other, are collectively referred to as "microstrip line 141".

The microstrip line 141-1 includes a part 142-1 extending from the second impedance transformation unit 34 in the positive Y direction, a part 143-1 extending from the part 142-1 in the positive X direction, and a part 144-1 extending from the part 143-1 in the positive Y direction. An end 148 of the part 144-1 positioned on the positive Y direction side is connected to the antenna element 121-1. An end 147 of the part 142-2 positioned on the negative Y direction side is connected to the second impedance transformation unit 34. The microstrip line 141-1 is bent at the bent portion 145 between the part 142-1 and the part 143-1, and is also bent at the bent portion 146 between the part 143-1 and the part 144-1. The bend angle of each of the bent portions 145 and 146 is a right angle. On the microstrip line 141-1, the bent portion 145 is the boundary between the part 142-1 and the part 143-1. On the microstrip line 141-1, the bent portion 146 is the boundary between the part 143-1 and the part 144-1.

The microstrip line 141-2 includes a part 142-2 extending from the second impedance transformation unit 34 in the positive Y direction, a part 143-2 extending from the part 142-2 in the negative X direction, and a part 144-2 extending from the part 143-2 in the positive Y direction. An end 148 of the part 144-2 positioned on the positive Y direction side is connected to the antenna element 121-2. An end 147 of the part 142-2 positioned on the negative Y direction side is connected to the second impedance transformation unit 34. The microstrip line 141-2 is bent at the bent portion 145 between the part 142-2 and the part 143-2, and is also bent at the bent portion 146 between the part 143-2 and the part 144-2. The bend angle of each of the bent portions 145 and 146 is a right angle. On the microstrip line 141-2, the bent portion 145 is the boundary between the part 142-2 and the part 143-2. On the microstrip line 141-2, the bent portion 146 is the boundary between the part 143-2 and the part 144-2.

The Y coordinate of the bent portions 145 and 146 of the microstrip line 141-1 is equal to the Y coordinate of the bent portions 145 and 146 of the microstrip line 141-2. On the microstrip line 141, a length L2 in the Y-axis direction from the end 148 to the bent portions 145 and 146 is shorter than a length L1 in the Y-axis direction from the end 147 to the bent portions 145 and 146. That is, the bent portions 145 and 146 are located on the positive Y direction side of the center between the end 147 and the end 148 in the Y-axis direction.

At the position of the bent portions 145 and 146 of the microstrip line 141, the direction of the transmission path is changed by 90 degrees, and thus unwanted electromagnetic radiation may occur. As the source of electromagnetic radiation from the antenna element 121 is more distant from the source of electromagnetic radiation on the transmission path, there is a greater change in the phase difference between the electromagnetic waves from the antenna element 121 and the electromagnetic waves on the transmission path at each angle of direction on the X-Y plane. As there is a greater change in the phase difference between the electromagnetic waves from the antenna element 121 and the electromagnetic waves on the transmission path, shorter-period ripples are generated in the radiation pattern of the antenna element 121.

On the transmission path of the antenna device 140, because the length L2 is smaller than the length L1, the bent portions 145 and 146 are provided at a position closer to the antenna element 121 relative to the center between the end 147 and the end 148. As the bent portions 145 and 146 are provided at a position closer to the antenna element 121, the period of the ripples generated in the radiation pattern of the antenna element 121 becomes long. The ripple period becomes longer, so that the antenna device 140 can reduce a change in the gain at each angle of direction. Because of a reduced change in the gain at each angle of direction, the antenna device 140 can obtain stable and high electric performance.

In designing the antenna device 140, the X coordinate and the Y coordinate of the waveguide microstrip line converter 57 and the X coordinate and the Y coordinate of the antenna element 121 are assumed to have been determined in advance according to the design limitations. The length of each portion of the microstrip line 141 is adjusted such that the waveguide microstrip line converter 57 and the antenna element 121 can be connected. In adjusting the length, the microstrip line 141-1 and the microstrip line 141-2 are made symmetric in the X-axis direction.

The antenna device 140 includes the microstrip line 141-1 and the microstrip line 141-2 that are symmetric in the X-axis direction, so that the transmission path of the antenna device 140 is symmetric in its entirety in the X-axis direction. The antenna device 140 has a configuration in which the transmission path is symmetric in the X-axis direction, and thus can reduce imbalance in electromagnetic radiation and obtain high electric performance accordingly.

According to the eighth embodiment, the antenna device 140 includes the waveguide microstrip line converter 57, and the antenna element 121 is connected to the microstrip line 141 having the length L2 smaller than the length L1. Thus, the antenna device 140 can obtain stable and high electric performance while making it possible to improve the reliability.

It is permissible that the antenna device 140 according to the eighth embodiment includes any of the waveguide microstrip line converters 10, 51, 53, and 55 according to the above first embodiment instead of the waveguide microstrip line converter 57. In a case where the antenna device 140 includes any of the waveguide microstrip line converters 10, 51, 53, and 55, the antenna device 140 can also obtain stable and high electric performance because of a reduction in ripples and a reduction in power loss, similarly to the case where the antenna device 140 includes the waveguide microstrip line converter 57.

Ninth Embodiment

Figure 29:
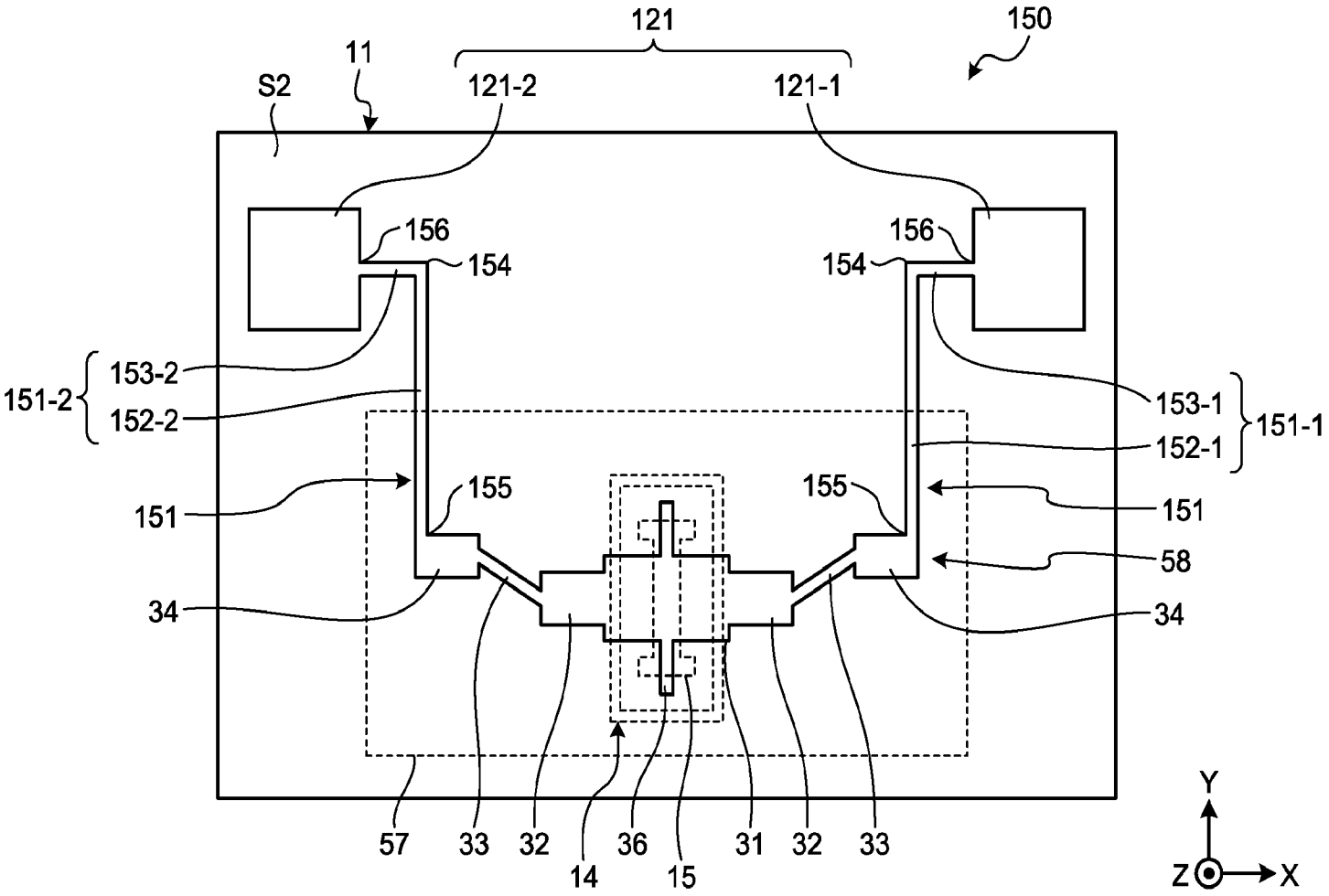
FIG. 29 is a plan view of an antenna device according to a ninth embodiment of the present invention.

FIG. 29 is a plan view of an antenna device 150 according to a ninth embodiment of the present invention. The antenna device 150 includes microstrip lines 151-1 and 151-2 instead of the microstrip lines 35-1 and 35-2 according to the sixth embodiment. Each of the microstrip lines 151-1 and 151-2 includes a bent portion 154. In the ninth embodiment, constituent elements identical to those of the first to eighth embodiments are denoted by like reference signs, and configurations different from those of the first to eighth embodiments are mainly described.

The antenna device 150 is a planar antenna that transmits and receives microwaves or millimeterwaves. The antenna device 150 includes two antenna elements 121-1 and 121-2 constituting the antenna. The microstrip lines 151-1 and 151-2, when they are not distinguished from each other, are collectively referred to as "microstrip line 151".

The microstrip line 151-1 includes a part 152-1 extending from the second impedance transformation unit 34 in the positive Y direction, and a part 153-1 extending from the part 152-1 in the positive X direction. An end 156 of the part 153-1 positioned on the positive X direction side is connected to the antenna element 121-1. An end 155 of the part 152-1 positioned on the negative Y direction side is connected to the second impedance transformation unit 34. The microstrip line 151-1 includes the bent portion 154 between the part 152-1 and the part 153-1. The bend angle of the bent portion 154 is a right angle. On the microstrip line 151-1, the bent portion 154 is the boundary between the part 152-1 and the part 153-1.

The microstrip line 151-2 includes a part 152-2 extending from the second impedance transformation unit 34 in the positive Y direction, and a part 153-2 extending from the part 152-2 in the negative X direction. An end 156 of the part 153-2 positioned on the negative X direction side is connected to the antenna element 121-2. An end 155 of the part 152-2 positioned on the negative Y direction side is connected to the second impedance transformation unit 34. The microstrip line 151-2 is bent at the bent portion 154 between the part 152-2 and the part 153-2. The bend angle of the bent portion 154 is a right angle. On the microstrip line 151-2, the bent portion 154 is the boundary between the part 152-2 and the part 153-2.

The end 156 is connected to the center of the antenna element 121 in the Y-axis direction. The Y coordinate of the bent portion 154 is equal to the Y coordinate of the center of the antenna element 121 in the Y-axis direction. The Y coordinate of the bent portion 154 of the microstrip line 151-1 is equal to the Y coordinate of the bent portion 154 of the microstrip line 151-2.

At the position of the bent portion 154, the direction of the transmission path is changed by 90 degrees, and thus unwanted electromagnetic radiation may occur. Because the Y coordinate of the bent portion 154 is equal to the Y coordinate of the center of the antenna element 121, there is no phase difference to be generated on the Y-Z plane between electromagnetic waves radiated from the antenna element 121 and electromagnetic waves radiated from the bent portion 154. The antenna device 150 can reduce ripples to be generated on the Y-Z plane attributable to electromagnetic radiation from the bent portion 154. Because of a reduction in ripples, the antenna device 150 can obtain stable and high electric performance.

It is permissible that the end 156 is connected to a portion of the antenna element 121 at a position other than the center in the Y-axis direction. The end 156 is connected to the antenna element 121, and consequently the Y coordinate of the bent portion 154 falls within the range of the antenna element 121 in the Y-axis direction. Because the Y coordinate of the bent portion 154 falls within the range of the antenna element 121 in the Y-axis direction, the phase difference on the Y-Z plane described above can be reduced. Thus, because the end 156 is connected to the antenna element 121, the antenna device 150 can reduce ripples to be generated on the Y-Z plane.

In designing the antenna device 150, the X coordinate and the Y coordinate of the waveguide microstrip line converter 57 and the X coordinate and the Y coordinate of the antenna element 121 are assumed to have been determined in advance according to the design limitations. The length of each portion of the microstrip line 151 is adjusted such that the waveguide microstrip line converter 57 and the antenna element 121 can be connected. In adjusting the length, the microstrip line 151-1 and the microstrip line 151-2 are made symmetric in the X-axis direction.

The antenna device 150 includes the microstrip line 151-1 and the microstrip line 151-2 that are symmetric in the X-axis direction, so that the transmission path of the antenna device 150 is symmetric in its entirety in the X-axis direction. The antenna device 150 has a configuration in which the transmission path is symmetric in the X-axis direction, and thus can reduce imbalance in electromagnetic radiation and obtain high electric performance accordingly.

According to the ninth embodiment, the antenna device 150 includes the waveguide microstrip line converter 57, and the Y coordinate of the bent portion 154 falls within the range of the antenna element 121 in the Y-axis direction. Thus, the antenna device 150 can obtain stable and high electric performance while making it possible to improve the reliability.

It is permissible that the antenna device 150 according to the ninth embodiment includes any of the waveguide microstrip line converters 10, 51, 53, and 55 according to the above first embodiment instead of the waveguide microstrip line converter 57. In a case where the antenna device 150 includes any of the waveguide microstrip line converters 10, 51, 53, and 55, the antenna device 150 can also obtain stable and high electric performance because of a reduction in ripples and a reduction in power loss, similarly to the case where the antenna device 150 includes the waveguide microstrip line converter 57.

Tenth Embodiment

Figure 30:
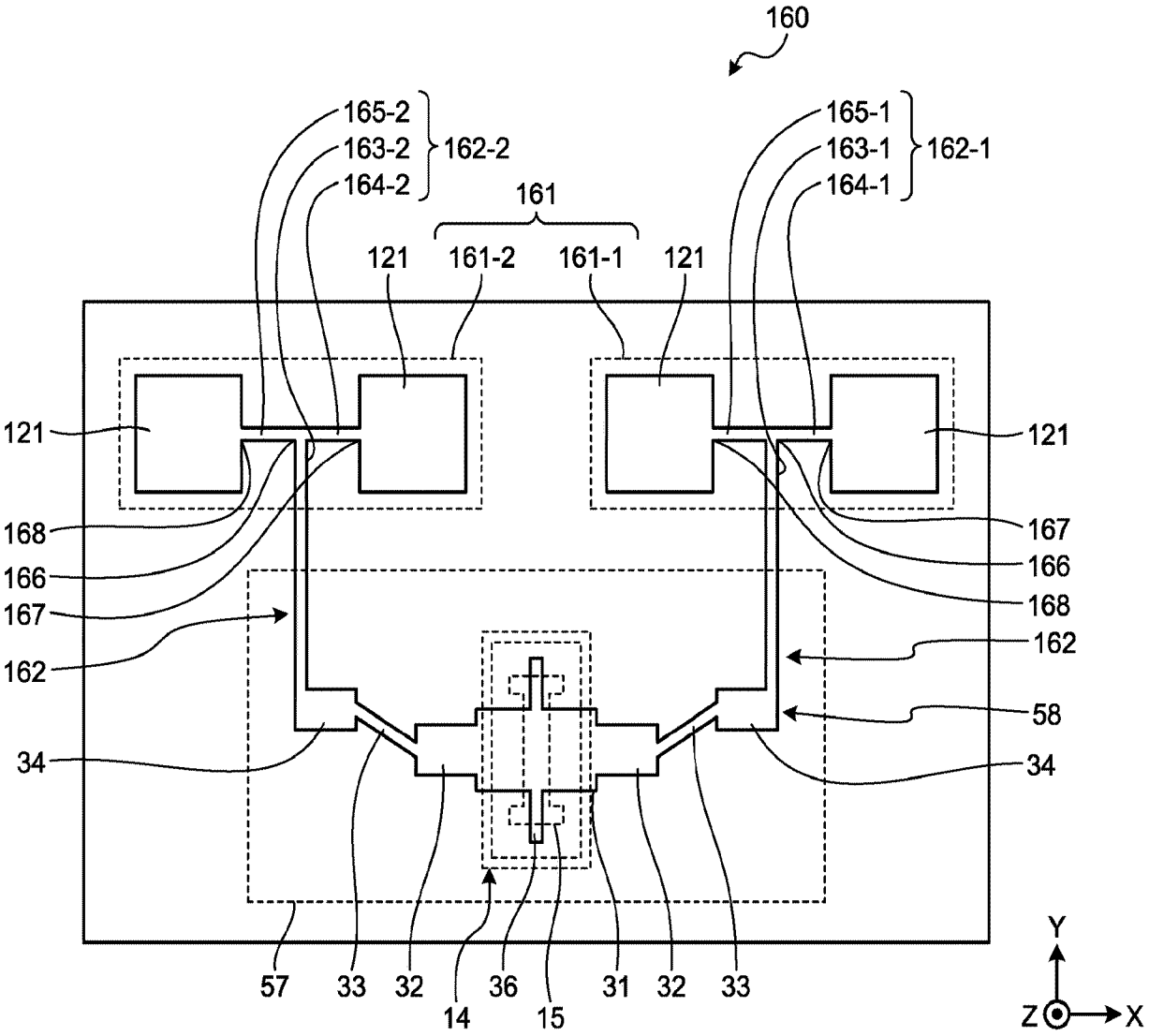
FIG. 30 is a plan view of an antenna device according to a tenth embodiment of the present invention.

FIG. 30 is a plan view of an antenna device 160 according to a tenth embodiment of the present invention. The antenna device 160 includes microstrip lines 162-1 and 162-2 instead of the microstrip lines 35-1 and 35-2 according to the sixth embodiment. Each of the microstrip lines 162-1 and 162-2 has branches. In the tenth embodiment, constituent elements identical to those of the first to ninth embodiments are denoted by like reference signs, and configurations different from those of the first to ninth embodiments are mainly described.

The antenna device 160 is a planar antenna that transmits and receives microwaves or millimeterwaves. The antenna device 160 includes two array antennas 161-1 and 161-2. Each of the array antennas 161-1 and 161-2 is an antenna including two antenna elements 121 arrayed in the X-axis direction. The array antennas 161-1 and 161-2, when they are not distinguished from each other, are collectively referred to as "array antenna 161". The microstrip lines 162-1 and 162-2, when they are not distinguished from each other, are collectively referred to as "microstrip line 162".

The microstrip line 162-1 includes a part 163-1 extending from the second impedance transformation unit 34 in the positive Y direction, and branches respectively extending from the part 163-1 toward the two antenna elements 121. An end of the part 163-1 located on the positive Y direction side is positioned between the two antenna elements 121 included in the array antenna 161-1. The microstrip line 162-1 includes a part 164-1 extending from the end of the part 163-1 in the positive X direction and a part 165-1 extending from the end of the part 163-1 in the negative X direction. A branch portion 166, at a position from which the microstrip line 162-1 branches off, is the boundary between the part 163-1, the part 164-1, and the part 165-1. One of the two antenna elements 121 included in the array antenna 161-1 is connected to an end 167 of the part 164-1 positioned on the positive X direction side. The other of the two antenna elements 121 is connected to an end 168 of the part 165-1 positioned on the negative X direction side.

The microstrip line 162-2 includes a part 163-2 extending from the second impedance transformation unit 34 in the positive Y direction, and branches respectively extending from the part 163-2 toward the two antenna elements 121. An end of the part 163-2 located on the positive Y direction side is positioned between the two antenna elements 121 included in the array antenna 161-2. The microstrip line 162-2 includes a part 164-2 extending from the end of the part 163-2 in the positive X direction and a part 165-2 extending from the end of the part 163-2 in the negative X direction. A branch portion 166, at a position from which the microstrip line 162-2 branches off, is the boundary between the part 163-2, the part 164-2, and the part 165-2. One of the two antenna elements 121 included in the array antenna 161-2 is connected to an end 167 of the part 164-2 positioned on the positive X direction side. The other of the two antenna elements 121 is connected to an end 168 of the part 165-2 positioned on the negative X direction side.

Each of the ends 167 and 168 is connected to the center of the antenna element 121 in the Y-axis direction. The Y coordinate of the branch portion 166 is equal to the Y coordinate of the center of the antenna element 121 in the Y-axis direction. The Y coordinate of the branch portion 166 of the microstrip line 162-1 is equal to the Y coordinate of the branch portion 166 of the microstrip line 162-2.

At the position of the branch portion 166, the direction of the transmission path is changed by 90 degrees, and thus unwanted electromagnetic radiation may occur. Because the Y coordinate of the branch portion 166 is equal to the Y coordinate of the center of the antenna element 121, there is no phase difference to be generated on the Y-Z plane between electromagnetic waves radiated from the antenna element 121 and electromagnetic waves radiated from the branch portion 166. The antenna device 160 can reduce ripples to be generated on the Y-Z plane attributable to electromagnetic radiation from the branch portion 166. Because of a reduction in ripples, the antenna device 160 can obtain stable and high electric performance.

It is permissible that each of the ends 167 and 168 is connected to a portion of the antenna element 121 at a position other than the center in the Y-axis direction. In a state where each of the ends 167 and 168 is connected to the antenna element 121, the Y coordinate of the branch portion 166 falls within the range of the antenna element 121 in the Y-axis direction. Because the Y coordinate of the branch portion 166 falls within the range of the antenna element 121 in the Y-axis direction, the phase difference on the Y-Z plane described above can be reduced. Because the Y coordinate of the branch portion 166 falls within the range of the antenna element 121 in the Y-axis direction, the antenna device 160 can reduce ripples to be generated on the Y-Z plane.

In designing the antenna device 160, the X coordinate and the Y coordinate of the waveguide microstrip line converter 57, and the X coordinate and the Y coordinate of the antenna element 121 are assumed to have been determined in advance according to the design limitations. The length of each portion of the microstrip line 162 is adjusted such that the waveguide microstrip line converter 57 and the antenna element 121 can be connected. In adjusting the length, the microstrip line 162-1 and the microstrip line 162-2 are made symmetric in the X-axis direction.

The antenna device 160 includes the microstrip line 162-1 and the microstrip line 162-2 that are symmetric in the X-axis direction, so that the transmission path of the antenna device 160 is symmetric in its entirety in the X-axis direction. The antenna device 160 has a configuration in which the transmission path is symmetric in the X-axis direction, and thus can reduce imbalance in electromagnetic radiation and obtain high electric performance accordingly.

According to the tenth embodiment, the antenna device 160 includes the waveguide microstrip line converter 57, and the Y coordinate of the branch portion 166 falls within the range of the antenna element 121 in the Y-axis direction. Thus, the antenna device 160 can obtain stable and high electric performance while making it possible to improve the reliability.

It is permissible that the antenna device 160 according to the tenth embodiment includes any of the waveguide microstrip line converters 10, 51, 53, and 55 according to the above first embodiment instead of the waveguide microstrip line converter 57. In a case where the antenna device 160 includes any of the waveguide microstrip line converters 10, 51, 53, and 55, the antenna device 160 can also obtain stable and high electric performance because of a reduction in ripples and a reduction in power loss, similarly to the case where the antenna device 160 includes the waveguide microstrip line converter 57.

The configurations described in the above embodiments are only examples of the content of the present invention. The configurations can be combined with other well-known techniques, and part of each of the configurations can be omitted or modified without departing from the scope of the present invention.

REFERENCE SIGNS LIST

10, 51, 53, 55, 57, 59, 61, 63, 65, 67 waveguide microstrip line converter, 11, 26 dielectric substrate, 12 ground conductor, 13, 52, 54, 56, 58, 60, 62, 64, 66, 68 line conductor, 14 waveguide, 15, 25 slot, 16 opening end, 17 input-output end, 18 opening edge portion, 19 pipe wall, 21 central portion, 22 end portion, 31 conversion unit, 32, 32-1, 32-2 first impedance transformation unit, 33, 33-1, 33-2 third impedance transformation unit, 34, 34-1, 34-2 second impedance transformation unit, 35, 35-1, 35-2, 40, 43, 70, 71, 73, 74, 75, 102, 124, 128, 131, 131-1, 131-2, 141, 141-1, 141-2, 151, 151-1, 151-2, 162, 162-1, 162-2 microstrip line, 36 stub, 37, 38, 38-1, 38-2, 39, 39-1, 39-2, 135, 136, 147, 148, 155, 156, 167, 168 end, 41 fourth impedance transformation unit, 42 fifth impedance transformation unit, 44 first area, 45 second area, 46, 47, 76, 134, 145, 146, 154 bent portion, 48-1, 48-2 boundary, 72 sixth impedance transformation unit, 77, 78 section, 100, 110, 120, 122, 125, 126, 130, 140, 150, 160 antenna device, 101 antenna, 103, 121, 121-1, 121-2 antenna element, 123, 123-1, 123-2, 127, 127-1, 127-2, 161, 161-1, 161-2 array antenna, 132-1, 132-2, 133-1, 133-2, 142-1, 142-2, 143-1, 143-2, 144-1, 144-2, 152-1, 152-2, 153-1, 153-2, 163-1, 163-2, 164-1, 164-2, 165-1, 165-2 part, 166 branch portion, S1 first surface, S2 second surface.

The invention claimed is:

1. An antenna device, comprising:

a waveguide microstrip line converter; and an antenna element connected to the waveguide microstrip line converter, wherein the waveguide microstrip line converter includes a waveguide including an opening end;

a dielectric substrate including a first surface facing the opening end and a second surface opposite to the first surface;

a ground conductor provided on the first surface, the opening end being connected to the ground conductor and the ground conductor being provided with a slot in a region surrounded by an edge portion of the opening end; and a line conductor provided on the second surface, and including a first section that is a microstrip line having a first line width, a second section positioned immediately above the slot and having a second line width greater than the first line width, and a third section extending from the second section in a first direction and performing impedance matching between the first section and the second section, wherein one end of opposite ends of the third section in the first direction is connected to the second section, the first section extends in a second direction perpendicular to the first direction continuously from a part of the third section that includes another end of the opposite ends of the third section in the first direction, the first line width and a line width, in the second direction, of the part of the third section that includes the other end are different from each other, and the antenna element is connected to an end of the first section.

2. The antenna device according to claim 1, wherein the third section includes a plurality of impedance transformation units to perform the impedance matching, and among the impedance transformation units, impedance transformation units adjacent to each other have different line widths from each other.

3. The antenna device according to claim 2, wherein a line width of each of the impedance transformation units is smaller than the second line width.

4. The antenna device according to claim 2, wherein the impedance transformation units include an impedance transformation unit having a line width greater than the first line width.

5. The antenna device according to claim 2, wherein the impedance transformation units include an impedance transformation unit constituting a transmission path in the first direction and an impedance transformation unit constituting a transmission path extending in a diagonal direction between the first direction and the second direction.

6. The antenna device according to claim 5, wherein the impedance transformation units include a first impedance transformation unit, a second impedance transformation unit, and a third impedance transformation unit, the third impedance transformation unit being provided between the first impedance transformation unit and the second impedance transformation unit and having a line width smaller than a line width of the first impedance transformation unit and smaller than a line width of the second impedance transformation unit, and the third impedance transformation unit constitutes a transmission path extending in the diagonal direction.

7. The antenna device according to claim 1, wherein the line conductor includes the third section positioned on one side of the second section in the first direction and the third section positioned on another side of the second section in the first direction, and the line conductor further includes a fourth section including a first area extending in the second direction continuously from the first section extending from the third section positioned on the one side, a second area extending from the first area toward the another side, and a bent portion between the first area and the second area.

8. The antenna device according to claim 7, wherein a total line length of the first section and the first area is equal to or smaller than one-fourth of a wavelength of a high-frequency signal to be transmitted through the line conductor.

9. The antenna device according to claim 7, wherein the line conductor includes a fifth section to which a transmission path including the first section extending from the third section positioned on the one side and a transmission path including the first section extending from the third section positioned on the another side are connected, a fourth impedance transformation unit to perform impedance matching between the fourth section and the fifth section, and a fifth impedance transformation unit to perform impedance matching between the fifth section and the first section extending from the third section positioned on the another side.

10. The antenna device according to claim 1, wherein the line conductor includes a branch section branching off from the second section and having an open end on a side opposite to the second section.

11. The antenna device according to claim 10, wherein the branch section extends in the second direction from an end of the second section in the second direction, and a center position of the branch section in the first direction is offset in the first direction from a center position of the slot in the first direction.

12. The antenna device of claim 1, wherein the third section includes three parts having different line widths, including a first part including the one end, the part including the other end, and a second part between the first part and the part including the other end, wherein the second part has a smaller width that the first part and the part including the other end.

13. The antenna device according to claim 1, wherein the first section has a linear shape extending from the third section in the second direction, and the antenna element is connected to one end of opposite ends of the first section in the second direction, the one end being opposite to another end of the opposite ends and the another end being connected to the third section.

14. The antenna device according to claim 1, wherein the first section is bent at a bent portion between a part extending from the third section in the second direction and another part extending from the part in a diagonal direction between the first direction and the second direction, and the bent portion forms an obtuse bend angle.

15. The antenna device according to claim 1, wherein the first section is bent at a bent portion between a part extending in the second direction and another part extending in the first direction, and a length of the first section in the second direction from an end connected to the antenna element to the bent portion is smaller than a length of the first section in the second direction from an end connected to the third section to the bent portion.

16. The antenna device according to claim 1, wherein the first section is bent at a bent portion between a part extending in the second direction and another part extending from the part to the end connected to the antenna element, and a position of the bent portion in the second direction falls within a range of the antenna element in the second direction.

17. The antenna device according to claim 1, wherein the first section includes a branch extending toward each of a plurality of the antenna elements from a part extending in the second direction, and a position of the branch in the second direction falls within a range of the antenna elements in the second direction.

18. An antenna device, comprising:

a waveguide microstrip line converter; and an antenna element connected to the waveguide microstrip line converter, wherein the waveguide microstrip line converter includes a waveguide including an opening end;

a dielectric substrate including a first surface facing the opening end and a second surface opposite to the first surface;

a ground conductor provided on the first surface, the opening end being connected to the ground conductor and the ground conductor being provided with a slot in a region surrounded by an edge portion of the opening end; and a line conductor provided on the second surface, and including a first section that is a microstrip line having a first line width, a second section positioned immediately above the slot and having a second line width greater than the first line width, and a third section extending from the second section in a first direction and performing impedance matching between the first section and the second section, wherein one end of opposite ends of the third section in the first direction is connected to the second section, the first section extends in a second direction perpendicular to the first direction continuously from another end of the opposite ends of the third section, the first line width and a line width of a part of the third section including the other end are different from each other, and the antenna element is connected to an end of the first section, wherein the line conductor includes a branch section branching off from the second section and having an open end on a side opposite to the second section.

19. An antenna device, comprising:

a waveguide microstrip line converter; and an antenna element connected to the waveguide microstrip line converter, wherein the waveguide microstrip line converter includes a waveguide including an opening end;

a dielectric substrate including a first surface facing the opening end and a second surface opposite to the first surface;

a ground conductor provided on the first surface, the opening end being connected to the ground conductor and the ground conductor being provided with a slot in a region surrounded by an edge portion of the opening end; and a line conductor provided on the second surface, and including a first section that is a microstrip line having a first line width, a second section positioned immediately above the slot and having a second line width greater than the first line width, and a third section extending from the second section in a first direction and performing impedance matching between the first section and the second section, wherein one end of opposite ends of the third section in the first direction is connected to the second section, the first section extends in a second direction perpendicular to the first direction continuously from another end of the opposite ends of the third section, the first line width and a line width of a part of the third section including the other end are different from each other, and the antenna element is connected to an end of the first section, wherein the first section is bent at a bent portion between a part extending from the third section in the second direction and another part extending from the part in a diagonal direction between the first direction and the second direction, and the bent portion forms an obtuse bend angle.

* * * * *